US007307643B2

(12) United States Patent
Moroo et al.

(10) Patent No.: US 7,307,643 B2
(45) Date of Patent: Dec. 11, 2007

(54) IMAGE DISPLAY CONTROL UNIT, IMAGE DISPLAY CONTROL METHOD, IMAGE DISPLAYING APPARATUS, AND IMAGE DISPLAY CONTROL PROGRAM RECORDED COMPUTER-READABLE RECORDING MEDIUM

(75) Inventors: Jun Moroo, Kawasaki (JP); Tsugio Noda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 35 days.

(21) Appl. No.: 09/826,914

(22) Filed: Apr. 6, 2001

(65) Prior Publication Data

US 2002/0057281 A1 May 16, 2002

(30) Foreign Application Priority Data

Nov. 10, 2000 (JP) ..... 2000-343357

(51) Int. Cl.
*G09G 5/00* (2006.01)

(52) U.S. Cl. ..... 345/667

(58) Field of Classification Search ..... 345/667, 345/668, 660, 661, 666, 472, 800, 698, 699, 345/671, 472.1, 472.2; 715/503, 521, 527
See application file for complete search history.

(56) References Cited

U.S. PATENT DOCUMENTS 4,283,724 A * 8/1981 Edwards ..... 345/26
4,755,955 A * 7/1988 Kimura et al. ..... 715/521
5,041,994 A * 8/1991 Lahey et al. ..... 358/1.11
5,073,965 A * 12/1991 Konishi et al. ..... 382/300
5,122,789 A * 6/1992 Ito ..... 345/671
5,202,670 A * 4/1993 Oha ..... 345/671
5,231,579 A * 7/1993 Tsuchiya et al. ..... 715/508
5,249,049 A * 9/1993 Kranawetter et al. ..... 348/473
5,283,561 A * 2/1994 Lumelsky et al. ..... 345/717

(Continued)

FOREIGN PATENT DOCUMENTS

JP 62-251970 11/1987

(Continued)

OTHER PUBLICATIONS

Notice of Rejection for Japanese Application 2002-343357 dated Jun. 16, 2004.

(Continued)

*Primary Examiner*—Ryan Yang
(74) *Attorney, Agent, or Firm*—Staas & Halsey LLP

(57) ABSTRACT

The present invention relates to an image display control unit comprising a screen size information obtaining section, an image information obtaining section for obtaining information on vertical and horizontal sizes of an image, an arithmetic section for calculating an image magnification ratio so that at least one of the vertical and horizontal sizes of the image substantially conforms with at least one of vertical and horizontal display-possible sizes of a display screen, and a display control section for displaying the image at the magnification ratio calculated in the arithmetic section on the display screen. With this arrangement, in displaying an image on a display screen, the image can be displayed automatically at the optimal magnification ratio on the display screen. Accordingly, the wasteful use of the display screen is avoidable, and the image appears on the display screen in an easy-to-see condition.

36 Claims, 14 Drawing Sheets

U.S. PATENT DOCUMENTS 5,314,256 A * 5/1994 Niwa ..... 400/61
5,351,064 A * 9/1994 Zenda ..... 345/3.3
5,459,477 A * 10/1995 Fukuda et al. ..... 345/2.1
5,508,714 A * 4/1996 Zenda ..... 345/3.3
5,596,346 A * 1/1997 Leone et al. ..... 345/667
5,619,226 A * 4/1997 Cahill, III ..... 345/667
5,635,951 A * 6/1997 Takahashi ..... 345/671
5,644,335 A * 7/1997 Mielekamp ..... 345/667
5,666,498 A * 9/1997 Amro ..... 345/800
5,717,939 A * 2/1998 Bricklin et al. ..... 715/503
5,739,867 A * 4/1998 Eglit ..... 348/581
5,742,261 A * 4/1998 Yuki et al. ..... 345/3.3
5,754,873 A * 5/1998 Nolan ..... 715/527
5,793,350 A * 8/1998 Chandavarkar et al. ..... 345/667
5,809,183 A * 9/1998 Serizawa et al. ..... 382/301
5,952,994 A * 9/1999 Ong et al. ..... 345/668
6,009,240 A 12/1999 Eguchi et al. ..... 358/1.16
6,067,070 A * 5/2000 Suzuki et al. ..... 345/660
6,081,277 A * 6/2000 Kojima ..... 345/661
6,339,434 B1 * 1/2002 West et al. ..... 345/667
6,348,931 B1 * 2/2002 Suga et al. ..... 345/699
6,388,638 B2 * 5/2002 Fukushima et al. ..... 345/7
6,392,660 B2 * 5/2002 Karjalainen ..... 345/660
6,392,673 B1 * 5/2002 Andrew et al. ..... 345/800
6,407,723 B1 * 6/2002 Okuno et al. ..... 345/3.2
6,407,749 B1 * 6/2002 Duke ..... 345/684
6,414,698 B1 * 7/2002 Lovell et al. ..... 345/800
6,417,866 B1 * 7/2002 Man et al. ..... 345/660
6,424,355 B2 * 7/2002 Watanabe et al. ..... 345/668
6,473,088 B1 * 10/2002 Matsumoto et al. ..... 345/530
6,477,572 B1 * 11/2002 Elderton et al. ..... 709/224
6,520,912 B1 * 2/2003 Brooks et al. ..... 600/437
6,549,214 B1 * 4/2003 Patel et al. ..... 345/660
6,567,088 B2 * 5/2003 Hayama ..... 345/472
6,570,583 B1 * 5/2003 Kung et al. ..... 345/661
6,577,322 B1 * 6/2003 Fukuda ..... 345/698
6,657,626 B1 * 12/2003 Shintoku ..... 345/467
6,798,915 B2 * 9/2004 Suh et al. ..... 382/232
6,833,844 B1 * 12/2004 Shiota et al. ..... 345/660
2001/0012008 A1 * 8/2001 Hongawa ..... 345/418
2001/0013865 A1 * 8/2001 Kamei ..... 345/418
2001/0038360 A1 * 11/2001 Fukushima et al. ..... 345/8
2001/0040585 A1 * 11/2001 Hartford et al. ..... 345/667
2002/0000998 A1 * 1/2002 Scott et al. ..... 345/667
2002/0030686 A1 * 3/2002 Sakai et al. ..... 345/531

FOREIGN PATENT DOCUMENTS

JP 05119696 A * 5/1993
JP 7-044557 2/1995
JP 8-101881 4/1996
JP 10-49653 2/1998
JP 10-151893 6/1998
JP 10-326169 12/1998
JP 2002-155848 6/2000

OTHER PUBLICATIONS

Japanese Patent Office for Japanese Patent Application No. 2000-343357; mailed Sep. 6, 2005.

* cited by examiner

FIG. 3

| |
|---|
| DISPLAY PAGE NUMBER i |
| SCALE RATIO |
| DISPLAY POSITION |
| ORIGINAL IMAGE |

FIG. 4

| DISPLAY PAGE NUMBER | AREA |
|---|---|
| 1 | SCALE RATIO |
| | DISPLAY POSITION |
| | ORIGINAL IMAGE |
| 2 | SCALE RATIO |
| | DISPLAY POSITION |
| | ORIGINAL IMAGE |
| ... | |
| N | SCALE RATIO |
| | DISPLAY POSITION |
| | ORIGINAL IMAGE |

(N: NUMBER OF IMAGE PAGES IN TOTAL)

FIG. 13

| DISPLAY PAGE NUMBER | AREA |
|---|---|
| 1 | SCALE RATIO |
| | FIRST DISPLAY POSITION |
| | SECOND DISPLAY POSITION |
| | ORIGINAL IMAGE |
| 2 | SCALE RATIO |
| | FIRST DISPLAY POSITION |
| | SECOND DISPLAY POSITION |
| | ORIGINAL IMAGE |
| ⋮ | ⋮ |
| N | SCALE RATIO |
| | FIRST DISPLAY POSITION |
| | SECOND DISPLAY POSITION |
| | ORIGINAL IMAGE |

(N: NUMBER OF IMAGE PAGES IN TOTAL)

KEY OPERATION : ONLY HORIZONTAL

IMAGE DISPLAY CONTROL UNIT, IMAGE DISPLAY CONTROL METHOD, IMAGE DISPLAYING APPARATUS, AND IMAGE DISPLAY CONTROL PROGRAM RECORDED COMPUTER-READABLE RECORDING MEDIUM

BACKGROUND OF THE INVENTION

1) Field of the Invention

The present invention relates to an image display control unit, image display control method, image displaying apparatus, and image display control program recorded computer-readable recording medium, suitable for use in an image displaying unit such as a portable terminal unit (PDA: Personal Digital Assistant) which displays an image on a small-sized display screen.

2) Description of the Related Art

In the recent years, portable information equipment reduced in size and weight have come into widespread use. These portable information equipment are provided with a small-sized display screen such as a liquid crystal display (LCD), and a user puts an image, stored in a storage device or the like in such portable information equipment, on a display screen for various purposes, such as for reading.

At this time, the user manipulates an operating button, a touch panel or the like on the body of the information equipment for selecting a desired image from a plurality of images stored in advance or for enlarging/reducing the image selected in this way on the display screen to display a desired portion of the image. Moreover, in such information equipment, an image display control unit is made to control the display of image data onto the display screen.

Meanwhile, such a conventional image display control unit is designed to make image reduction/enlargement display at predetermined magnification, for example, ⅛ size, ¼ size, half size, equal size, double size, four-times size and eight-times size, with respect to an image displayed on the display screen. For this reason, in order to put the image on the display screen in an easy-to-see condition, the user is required to press the operating button several times for adjusting the display magnification while repeatedly conducting the enlargement/reduction. This is troublesome to the user.

In addition, in displaying a rectangular image with a large aspect ratio on the small display screen of the portable information equipment, it is preferable that the image display is made to avoid a wasteful use of the display screen.

Still additionally, in displaying an image including characters on the display screen, an operating button or the like is pressed to adjust the display magnification while repeatedly conducting the enlargement/reduction so that the characters appear in an easy-to-see condition on the display screen. This is also troublesome.

Moreover, there has been known a method in which an index image produced by reducing image data is displayed on the display screen and switched successively to retrieve and select an image undergoing editing or the like. FIGS. 14A and 14B are illustrations useful for explaining index display in a conventional image displaying apparatus. FIG. 14A is an illustration for describing a key manipulating manner for index image switching, while FIG. 14B is an illustration of an example of an index image displayed on a display screen.

In the conventional displaying apparatus, in a state where an index image is displayed on a display screen as shown in FIG. 14B, a user selectively shifts an index image switching key in right/left directions as shown in FIG. 14A so that the index image is switched to another index image on the display screen.

In addition, in the conventional image displaying apparatus, the index image is made to appear on the display screen in a condition reduced to the extent that the contents of the image is understandable. The user presses the index image switching key while seeing the index image displayed on the display screen to successively switch the index image, and presses a selecting button (not shown) when a desired index image appears on the display screen. Thus, the user can see the detail of that image.

However, there still exist requirements for the improvement of convenience in displaying such an index image on the display screen.

SUMMARY OF THE INVENTION

The present invention has been developed in consideration of this situation, and it is therefore an object of the invention to provide an image display control unit, image display control method, image displaying apparatus and image display control program recorded computer-readable recording medium, which are capable of automatically displaying an image at an optimal magnification ratio with respect to a display screen, thus preventing a wasteful use of a display screen and displaying an image in an easy-to-see condition on the display screen.

For this purpose, in accordance with an aspect of the present invention, there is provided an image display control unit for displaying an image on a display screen, the control unit comprising a screen size information obtaining section (means) for obtaining information on a display size of the display screen, an image information obtaining section for obtaining information on vertical and horizontal sizes of the image, an arithmetic section for calculating an image magnification ratio so that at least one of the vertical and horizontal sizes of the image substantially conforms with at least one of vertical and horizontal display-possible sizes of the display screen, and a display control section for displaying the image at the calculated magnification ratio, on the display screen.

In addition, in accordance with another aspect of the present invention, there is provided an image display control method for displaying an image on a display screen of an image displaying apparatus, the control method comprising a screen size information obtaining step of obtaining information on a display size of the display screen, an image information obtaining step of obtaining information on vertical and horizontal sizes of the image, an arithmetic step of calculating an image magnification ratio so that at least one of the vertical and horizontal sizes of the image substantially conforms with at least one of vertical and horizontal display sizes of the display screen, and a display control step of displaying the image at the calculated magnification ratio, on the display screen.

Still additionally, in accordance with a further aspect of the present invention, there is provided an image displaying apparatus comprising a display screen for displaying an image, a screen size information obtaining section for obtaining information on a display size of the display screen, an image information obtaining section for obtaining information on vertical and horizontal sizes of the image, an arithmetic section for calculating an image magnification ratio so that at least one of the vertical and horizontal sizes of the image substantially conforms with at least one of vertical and horizontal display sizes of the display screen, and a display control section for displaying the image at the magnification ratio on the display screen.

Moreover, in accordance with a further aspect of the present invention, there is provided an image display control program recorded computer-readable recording medium which retains an image display control program for making a computer implement an image display control function to display an image on a display screen of an image displaying apparatus, the image display control program making the computer function as a screen size information obtaining section for obtaining information on a display size of the display screen, an image information obtaining section for obtaining information on vertical and horizontal sizes of the image, an arithmetic section for calculating an image magnification ratio so that at least one of the vertical and horizontal sizes of the image substantially conforms with at least one of vertical and horizontal display sizes of the display screen, and a display control section for displaying the image at the calculated magnification ratio on the display screen.

With these arrangements, in displaying an image on a display screen, at least one of vertical and horizontal dimensions of the image can be made to equal or substantially equal at least one vertical and horizontal display-possible sizes of the display screen.

In this connection, in the image display control unit, it is also appropriate that the arithmetic section calculates the image magnification ratios for when the vertical size of the image is set to substantially conform with the vertical display size of the display screen and for when the horizontal size of the image is set to substantially conform with the horizontal display size of the display screen, and selects the larger one of the calculated vertical and horizontal magnification ratios and outputs the selected magnification ratio to the display control section.

Moreover, in the image display control method, it is also appropriate that in the arithmetic step the image magnification ratios are calculated for when the vertical size of the image is set to substantially conform with the vertical display-possible size of the display screen and for when the horizontal size of the image is set to substantially conform with the horizontal display size of the display screen, and the larger magnification ratio is selected from the calculated vertical and horizontal magnification ratios.

Still moreover, in the image displaying apparatus, it is also appropriate that the arithmetic section calculates the image magnification ratios for when the vertical size of the image is set to substantially conform with the vertical display-possible size of the display screen and for when the horizontal size of the image is set to substantially conform with the horizontal display size of the display screen, and selects the larger one of the calculated vertical and horizontal magnification ratios and outputs the selected magnification ratio to the display control section.

Furthermore, in the image display control program recorded computer-readable recording medium, it is also appropriate that the program operates the arithmetic section to calculate the image magnification ratios for when the vertical size of the image is set to substantially conform with the vertical display-possible size of the display screen and for when the horizontal size of the image is set to substantially conform with the horizontal display-possible size of the display screen, and to select the larger one of the calculated vertical and horizontal magnification ratios for outputting the selected magnification ratio to the display control section.

Accordingly, the larger one of the vertical and horizontal image magnification ratios is taken for the vertical or horizontal display-possible size of the display screen, thus making effective use of the display screen.

In addition, an image display control unit according to the present invention, which displays an image on a display screen, comprises a character size detecting section for obtaining a size of a character included in the image, an arithmetic section for calculating an image magnification ratio of the image on the basis of the detected character size so that the character displayed at a predetermined size on the display screen, and a display control section for displaying the image at the calculated magnification ratio on the display screen.

Still additionally, an image display control method according to the present invention, which displays an image on a display screen, comprises a character size detecting step of obtaining a size of a character included in the image, an arithmetic step of calculating magnification ratio of the image on the basis of the detected character size so that the character is displayed at a predetermined size on the display screen, and a display control step of displaying the image at the calculated magnification ratio on the display screen.

Furthermore, an image displaying apparatus according to the present invention comprises a display screen for displaying an image, a character size detecting section for obtaining a size of a character included in the image, an arithmetic section for calculating an image magnification ratio of the image on the basis of the detected character size so that the character is displayed at a predetermined size on the display screen, and a display control section for displaying the image at the calculated magnification ratio on the display screen.

Still furthermore, an image display control program recorded computer-readable recording medium which retains an image display control program for making a computer implement an image display control function to display an image on a display screen of an image displaying apparatus, the image display control program making the computer function as a character size detecting section for obtaining a size of a character included in the image, an arithmetic section for calculating a magnification ratio of the image on the basis of the detected character size so that the character is displayed at a predetermined size on the display screen, and a display control section for displaying the image at the calculated magnification ratio on the display screen.

Thus, in a display screen, a character in an image can be displayed at a predetermined size.

Moreover, it is also acceptable that a scroll processing section is further provided to scroll the image on the display screen, or that an index image produced by reducing an original image is displayed as the image on the display screen.

Accordingly, it is possible to scroll an image on a display screen, and further to display an index image on the display screen, besides, in displaying the index image on the display screen, it is possible to scroll the index image.

In addition, it is also possible that the predetermined size is height of the character (for example, approximately 2 mm to 5 mm), that the predetermined size is the number of pixels for the character of height (for example, approximately 5 to 13 pixels), or that the predetermined size is a field angle in the character height direction (for example, approximately 0.19 to 0.475 degrees).

Still additionally, it is also possible that the calculated magnification ratio is retained in a state associated with an image, or that display position information on an image displayed on the display screen is retained in a state associated with an image. Moreover, it is also possible that a display magnification of an image displayed on the display screen is retained in a state associated with an image.

In displaying the index image, the position information on an image to be displayed is retained in a state associated with an original image.

As described above in detail, the image display control unit, image display control method, image displaying apparatus, and image display control program recorded computer-readable recording medium according to the present invention can provide the following effects or advantages.

(1) An image is displayed to conform or conform generally with at least one of the vertical and horizontal display sizes of a display screen, which enables the efficient use of the display screen and the display of an enlarged image on the display screen so that the image displayed on the display screen becomes easy to see, with improved convenience.

(2) An image is displayed on the display screen at the larger one of the vertical and horizontal image magnification ratios, which displays an image in a state enlarged to the utmost when the image is displayed on a rectangular display screen, with the result that the image becomes easy to see when appearing on the display screen, with improved convenience.

(3) An image magnification ratio is calculated on the basis of a detected character size so that a character in an image is displayed at a predetermined size on the display screen and the image is displayed at the calculated magnification ratio on the display screen, which allows a character in an image to be displayed at a predetermined size on the display screen, thus improving the visibility of the character on the display screen and, hence, improving the convenience.

(4) An image magnification ratio is calculated so that the field angle in a character height direction assumes a predetermined value (for example, approximately 0.38 to 0.95 (0.19 to 0.475) degrees) and an image is displayed at the calculated magnification ratio on the display screen; therefore, it is possible to display a character with a size easy to see on the display screen irrespective of the distance between the display screen and a user.

(5) A calculated magnification ratio is retained in a state associated with an image; therefore, it is possible to display the image through the use of this magnification ratio retained without again calculating the magnification ratio, which enhances the processing speed.

(6) Display position information on an image displayed on the display screen is retained in a state associated with the image; therefore, in displaying an image, it is possible to display that display position thereof preferentially, which eliminates a need for a user to conduct an operation for making display at that display position, thus leading to the improvement of convenience.

(7) A display magnification of an image displayed on the display screen is retained in a state associated with the image; hence, it is possible to display the image at that magnification ratio, that is, to display the image through the use of the retained magnification ratio without again calculating the magnification ratio, which leads to an increase in processing speed.

(8) Since an image is scrolled on the display screen, the image can be found easily and quickly, thus leading to the improvement of convenience.

(9) Since an index image produced by reducing an original image is displayed as an image on the display screen, in displaying an index image on the display screen, the index image can largely be displayed thereon, which provides an easy-to-see index image, thus leading to the improvement of convenience.

(10) Since, in displaying an index image, the position information on an image to be displayed is retained in a state associated with an original image, it is possible to preferentially display the index image at that display position, which eliminates a need for a user to conduct an operation for the display at that display position, leading to the improvement of convenience.

BRIEF DESCRIPTION OF THE DRAWINGS

FIG. 3 is an illustration of image information corresponding to one page extracted from a plurality of pages of the image information shown in FIG. 4;

FIG. 4 is an illustration of a data structure of display information on an image corresponding to a plurality of pages;

FIG. 13 illustratively shows a data structure of display information stored in an image information storing section of the image display control unit according to the third embodiment of the invention.

DESCRIPTION OF THE PREFERRED EMBODIMENTS

(A) Description of First Embodiment

Figure 1:
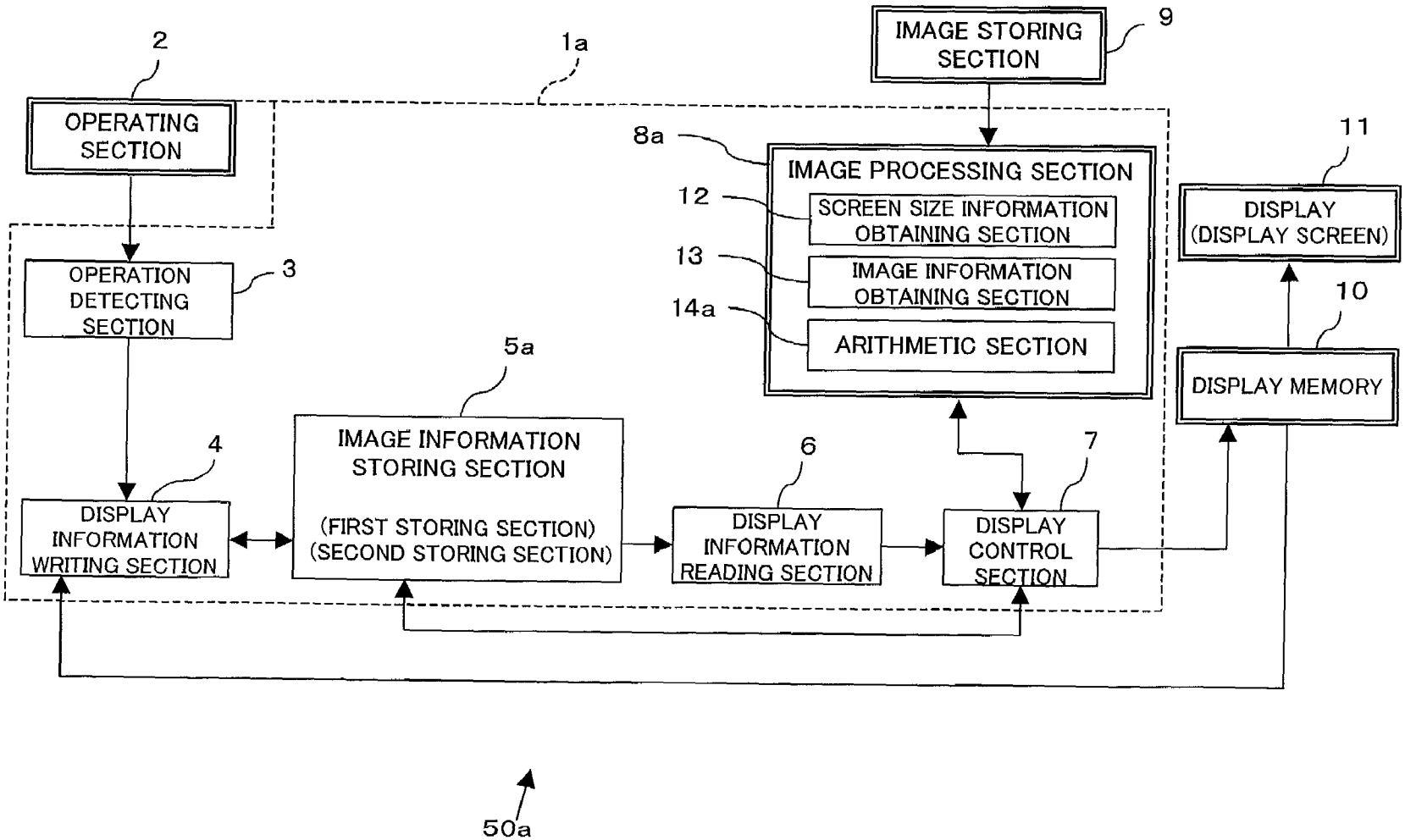
FIG. 1 is a block diagram showing a functional configuration of an image displaying apparatus equipped with an image display control unit according to a first embodiment of the present invention.
Figure 2:
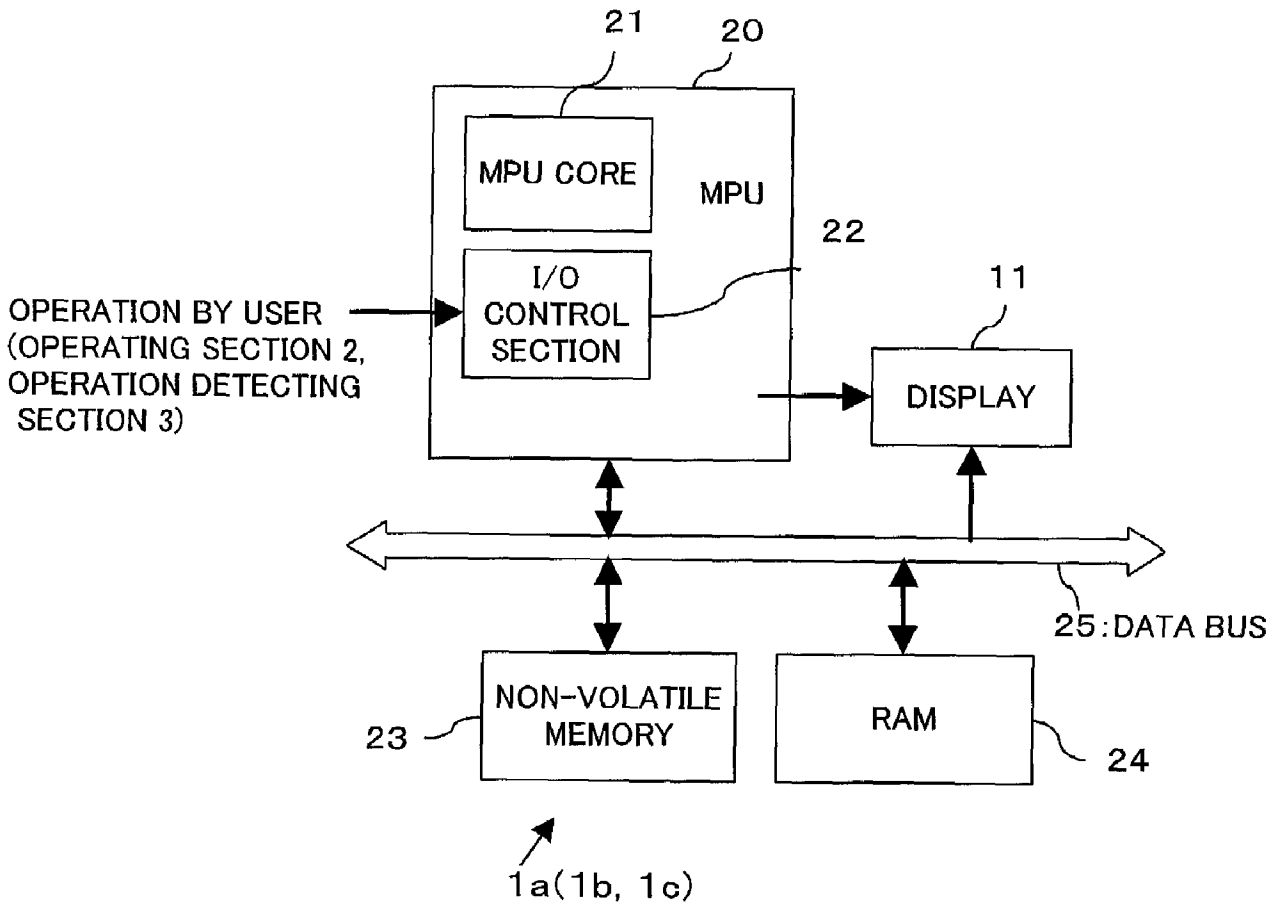
FIG. 2 is a block diagram showing a hardware configuration of an image display control unit according to each of embodiments of the invention.

FIG. 1 is a block diagram showing a functional configuration of an image displaying apparatus 50*a* including an image display control unit 1*a* according to a first embodiment of the present invention, and FIG. 2 is a block diagram showing a hardware configuration of this image display control unit 1*a*.

The image displaying apparatus 50*a* equipped with the image display control unit 1*a* according to the first embodiment of the invention is constructed with, for example, a portable type personal computer or a viewer, and is provided with a small-sized display device (display screen) such as a liquid crystal display (LCD) 11. The image display control unit 1*a* is designed to control the display of an image on this display device 11.

As FIG. 2 shows, this image display control unit 1*a* is made up of an MPU 20, a non-volatile memory 23 and a RAM 24, and is designed to control display of an image on the display device 11 in a manner that the MPU 20 executes a program stored in the non-volatile memory 23 or a hard disk (not shown). In addition, the MPU 20, the non-volatile memory 23, the RAM 24 and the display device 11 are connected through a data bus 25 to be capable of communicating with each other to mutually interchange various kinds of information through the data bus 25.

The MPU 20 comprises an MPU core 21 and an I/O control section 22. The MPU core 21 is for managing various types of arithmetic operations, and the I/O control section 22 is for processing an operation a user conducts through the use of a keyboard, a button or the like. Incidentally, the hardware configuration of the MPU 20 is not limited to this configuration, but the present invention covers all changes and modifications which do not constitute departures from the spirit and scope of the invention. For example, additional use of other circuits such as arithmetic circuits is also acceptable.

In addition, the MPU 20 executes a program (program for image display control) stored in a recording medium such as a hard disk or a ROM, thereby functioning as an operation detecting section 3, a display information writing section 4, a display information reading section 6, a display control section 7 and an image processing section 8*a*, which will be described herein later.

The non-volatile memory 23 is for storing various types of information in accordance with instructions from the MPU 20. This non-volatile memory 23 comprises a storage medium, such as a flash memory, battery-backed-up CMOS memory or a hard disk, and is made to prevent the loss of information stored even if the power supply to this apparatus stops. The RAM 24 is for temporarily loading data when the MPU 20 conducts arithmetic operations.

As FIG. 1 shows, the image displaying apparatus 50*a* includes the image display control unit 1*a*, an operating section 2, an image storing section 9, the display device 11 and a display memory 10. In addition, the image display control unit 1*a* according to this embodiment comprises an image information storing section 5*a*, an operation detecting section 3, a display information writing section 4, a display information reading section 6, a display control section 7 and an image processing section 8*a*.

The operating section 2 comprises, for example, a keyboard, a button or the like, and is used for when a user inputs various operations.

The operation detecting section 3 is for detecting the operation inputted through the operating section 2, and is realizable with the I/O control section 22. This operation detecting section 3 is made to make a decision on whether or not the operation inputted through the operating section 2 is an operation for changing a display state of an image on the display device 11. In the case of an input for an operation for changing the display state on the display device 11, a signal (detection signal) representative of the fact is given to the display information writing section 4.

The display information writing section 4 is for writing predetermined information on the image (display information; which will be described later) in the image information storing section 5*a*. This display information writing section 4 makes a decision, on the basis of the detection signal from the operation detecting section 3, as to whether or not display information is necessary to store in the image information storing section 5*a*. If the decision is "necessary to store", then the display information section 4 stores the display information in the image information storing section 5*a*.

The display information reading section 6 is for reading out predetermined information stored in the image information storing section 5 and for transmitting it to the display control section 7. This display information reading section 6 refers to the image information storing section 5*a* at the power-on or page-switching, and if display information on an image, to be displayed on the display device 11, exists in the image information storing section 5*a*, then reads out this display information.

The image storing section 9 is constructed with, for example, a recording medium such as a hard disk or a non-volatile memory, and is made to associate an image to be displayed on the display device 11 with a page number and to store the page number associated image. In the following description, a non-processed image stored in the image storing section 9 is referred to as an "original image".

The display control section 7 is for controlling for displaying an image on the display device 11, and is made to enlarge or reduce an image on the basis of a magnification ratio (which will be described in detail later) calculated in an arithmetic section 14*a* or a magnification ratio (which will be described in detail later) stored in the image information storing section 5*a* and read out by the display information reading section 6, and to hand over the enlarged/reduced image to the display memory 10.

This display control section 7 is made to generate a display image, to be displayed on the display device 11, on the basis of the display information obtained from the display information reading section 6 for loading the generated display image into the display memory 10.

When the display image is stored in the image information storing section 5*a*, the display control section 7 reads out the image and writes it in the display memory 10. On the other hand, if the display image does not exist in the image information storing section 5*a*, the display control section 7 notifies the image processing section 8*a* of the page number of that image for acquiring the image corresponding to the page number, and further makes the image processing section 8*a* (arithmetic section 14*a*) calculate an enlargement ratio or reduction ratio (referred to as a "magnification ratio") for generating the display image through the use of the calculated magnification ratio.

In addition, the display control section 7 is made to write the display information (see FIGS. 3 and 4) on the generated display image in the image information storing section 5*a* through the display memory 10 and the display information wiring section 4. In this connection, when an "original image" is put in this image information storing section 5*a*, a position (coordinate value) on the original image in the image displayed on the display device 11 is specified and stored as a "display position". Hence, the image at the coordinate position stored in the "display position" can be displayed on the display device 11.

The image information storing section 5*a* is, for example, a storage medium such as a non-volatile memory (flash memory, battery-backed-up CMOS memory, or the like) or a hard disk, which can prevent the loss of information stored even if the power supply is broken in the image displaying apparatus 50*a*.

FIGS. 3 and 4 illustratively show a data structure of display information to be stored in the image information storing section 5*a*. FIG. 3 is an illustration of image information corresponding to one page extracted from a plurality of pages of image information shown in FIG. 4, and shows a data structure of display information on an image at an ith page (i=i to N). And FIG. 4 is an illustration of a data structure of display information on an image corresponding to a plurality of pages.

As FIG. 3 shows, the image information storing section 5*a* is made to store "display page number i", "magnification ratio" and "original image" in a state associated with each other with respect to an image to be displayed on the display device 11, these display information inputted to the image information storing section 5*a* by the display information writing section 4.

In this display information, the "display page number i" represents a number for specifying one image, and signifies a page number of an image to be displayed on the display device 11, which is stored in the form of a natural number. Therefore, this specifies an image to be displayed, for example, at the power-on. The "magnification ratio" represents a ratio of a size of an image, to be displayed on the display device 11, to a size of an original image, with a value calculated in the arithmetic section 14*a* or a magnification ratio finally displayed on the display device 11 being stored.

The "display position" signifies a position of an image, (which will sometimes be referred to hereinafter as a "display image") which is enlarged or reduced to a display size on the display device 11 so as to display the image on the display device 11, the display position is expressed in the form of a coordinate position in a case in which a predetermined reference position (for example, an upper and left position) on an original image is set as the origin. The "original image" is an image produced by regenerating (copying) an image stored in the image storing section 9, for example, an image formed in the form of a bit map image or in various types of formats such as TIFF, JPEG or GIF.

If an original image is not stored in the image information storing section 5*a*, then information, which represent that no original image is stored, stored in the area allocated this "original image".

In addition, in the case of storing display information corresponding to a plurality of pages as mentioned above, the image information storing section 5*a* is made to store the information in a state associated with the "magnification ratio", the "display position" and the "original image"0 according to page as shown in FIG. 4.

That is, the image information storing section 5*a* functions as a first storing section to store the magnification ratio, which is calculated in the arithmetic section 14*a*, in a state associated with the corresponding image, and further functions as a second storing section to store the display position information, of an image displayed on the display device 11, in a state associated with the image.

The display memory 10 is for temporarily storing an image inputted from the display control section 7, and the display device 11 is for displaying the image stored in the display memory 10.

The image processing section 8*a* is for processing on an image stored in the image storing section 9, and if a decision, which is made by the display control section 7 in such way that an image at a page to be displayed on the display device 11 is not stored in the image information storing section 5*a*, it reads out an original image at a designated page from the image storing section 9 on the basis of the page number of that image and calculates a magnification ratio corresponding to the size of the display device 11 for notifying the display control section 7 of the calculated magnification ratio.

This image processing section 8*a* comprises a screen size information obtaining section 12, an image information obtaining section 13 and the arithmetic section 14*a*.

The screen size information obtaining section 12 is for obtaining information on a display-possible size of the display device 11, for example, is made to obtain a vertical size H1 and horizontal size W1 of the display device 11 stored, in a hard disk or the like, in advance, and for loading these sizes into the image information storing section 5*a* or the like.

In this connection, it is also appropriate that the screen size information obtaining section 12 obtains the information on the display-possible size directly from the display device 11, or a user inputs the information on the display-possible size through the operating section 2 in response to a request from the screen size information obtaining section 12.

The image information obtaining section 13 is for obtaining information on an original image stored in the image storing section 9, and is made to obtain a vertical size H2 and horizontal size W2 of this original image.

Incidentally, in the bit map (BMP) format, TIFF format or the like being commonly used as an image data format, a header portion of data is allocated information on a size of an image, and the image information obtaining section 13 can obtain the vertical size H2 and horizontal size W2 of the image from the information stored in this header portion through the use of an algorithm well known.

The arithmetic section 14*a* is for calculating a magnification ratio of an image so that at least one of the vertical and horizontal sizes conform or conform generally to the vertical or horizontal display-possible size H1, W2 of the display device 11.

Concretely, the arithmetic section 14*a* calculates image magnification ratios for when the vertical size of an image is set to conform or conform generally with the vertical display size H1 of the display device 11 and for when the horizontal size of the image is set to conform or conform generally to the horizontal display-possible size W1, and then selects the larger one of the vertical and horizontal image magnification ratios for outputting the selected magnification ratio to the display control section 7. Accordingly, the image magnification ratio calculated in the arithmetic section 14*a* can be expressed as:

magnification ratio=max [horizontal image magnification ratio ($W1/W2$), vertical image magnification ratio ($H1/H2$)].

In this embodiment, although the vertical size H1 and horizontal size W1 of the display device 11 are employed directly as the display-possible sizes of the display device 11, the present invention is not limited to this. For example, it is also possible that values obtained by subtracting a dimension corresponding to a predetermined margin from the vertical and horizontal sizes H1 and W1 of the display device 11 are used as the display-possible sizes, or that values previously set by a user are taken as the display-possible sizes. That is, the present invention covers all changes and modifications which do not constitute departures from the spirit and scope of the invention.

In addition, the image magnification ratio is also expressible as follows:

vertical image magnification ratio=vertical display-possible size of display device 11/vertical size of image=$H1/H2$, horizontal display-possible size of display device 11/horizontal size of image=$W1/W2$.

Figure 5:
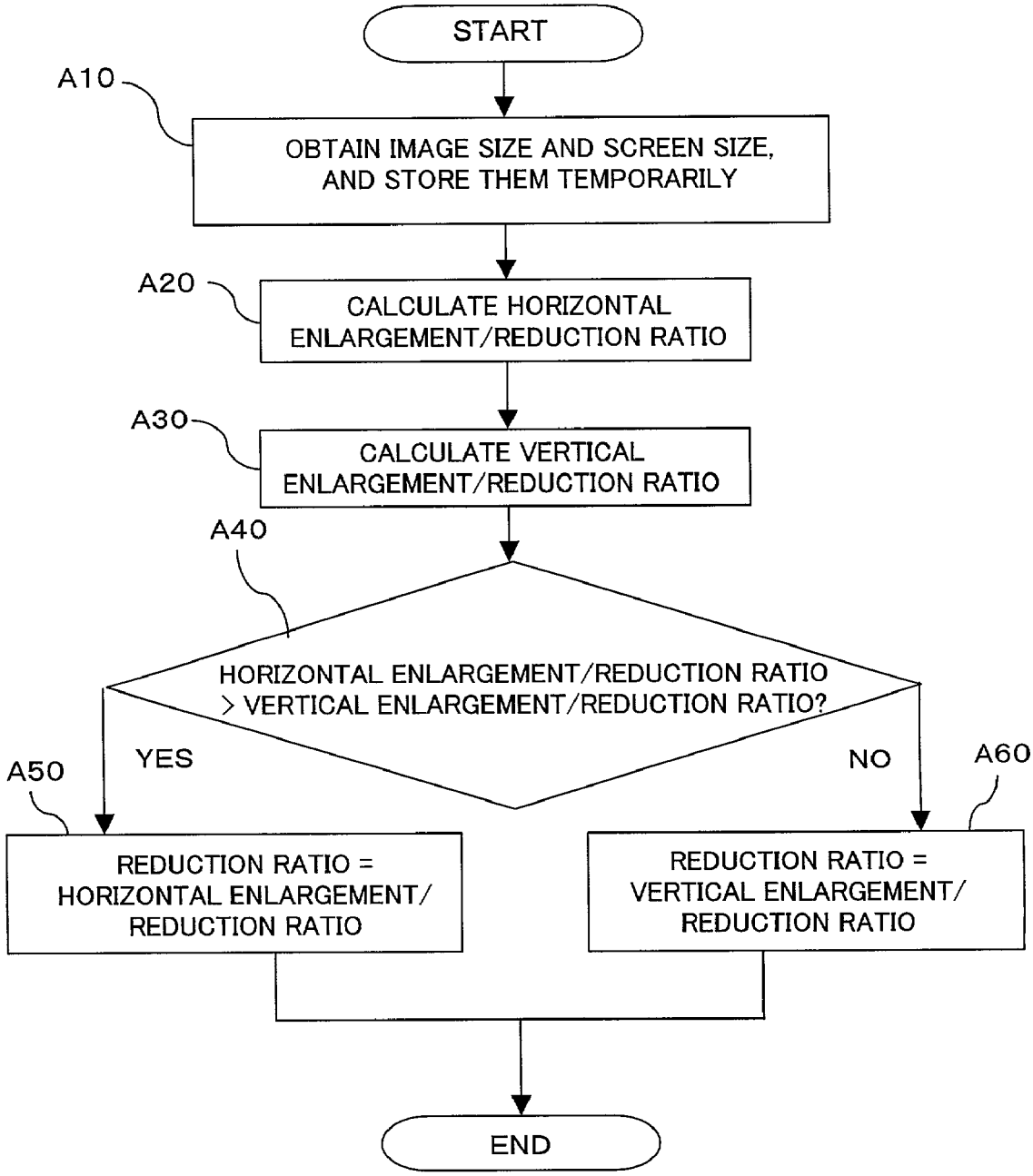
FIG. 5 is a flow chart useful for explaining control in displaying an image on a display by the image display control unit according to the first embodiment of the invention.

Secondly, referring to the flow chart (steps A10 to A60) of FIG. 5, a description will be given hereinbelow of control to be implemented for when the image display control unit 1*a* thus arranged according to the first embodiment of the present invention displays an image (original image) on the display device 11.

First of all, the screen size information obtaining section 12 obtains a vertical size H2 and horizontal size W2 of an original image stored in the image storing section 9 and temporarily loads them in the non-volatile memory 23, and the screen size information obtaining section 12 obtains a vertical size H1 and horizontal size W1 of the display device 11 and then loads them in the non-volatile memory 23 (step A10).

Furthermore, the arithmetic section 14*a* calculates an image magnification ratio (enlargement/reduction ratio) W1/W2 for when the horizontal size of the original image is set to conform or conform generally to the horizontal size W1 of the display device 11 (step A20), and also calculates an image magnification ratio (enlargement/reduction ratio) H1/H2 for when the vertical size of the image is set to conform or conform generally to the vertical display-possible size H1 of the display device 11 (step A30).

The arithmetic section 14*a* compares the vertical image magnification ratio H1/H2 with the horizontal image magnification ratio W1/W2 (step A40). If the horizontal image magnification ratio W1/W2 is larger than the vertical image magnification ratio H1/H2 (see "YES" route from step A40), the arithmetic section 14*a* selects the horizontal image magnification ratio W1/W2 and outputs it to the display control section 7 (step A50). On the other hand, if the vertical image magnification ratio H1/H2 is larger than the horizontal image magnification ratio W1/W2 (see "NO" route from step A40), the arithmetic section 14*a* selects the vertical image magnification ratio H1/H2 and outputs it to the display control section 7 (step A60).

In addition, the display control section 7 outputs the original image, which is stored in the image storing section 9, at the magnification ratio selected in the arithmetic section 14*a* to the display memory 10. The display device 11 displays the image stored in the display memory 10.

In this case, when a user inputs an instruction to the effect of temporarily store the image displayed on the display device 11 through the operating section 2, then the operation detecting section 3 detects the inputted instruction and then notifies the display information writing section 4 of them. Moreover, the display information writing section 4 loads, via the display control section 7, the magnification ratio calculated in the arithmetic section 14*a* and the coordinate information on the display position together with the original image in a predetermined area of the image information storing section 5*a*.

When the image, which is stored in the image information storing section 5*a*, is displayed on the display device 11, the display control section 7 obtains the display information from the image information storing section 5*a* and put it on the display device 11.

Thus, with the image display control unit l*a* and image displaying apparatus 50*a* according to the first embodiment of the present invention, the arithmetic section 14*a* calculates an image magnification ratio so that at least one of the vertical and horizontal image sizes conform or conform generally to the vertical or horizontal display-possible size H1 or W1 of the display device 11, while the display control section 7 displays the image at the magnification ratio calculated in this way; therefore, it is possible to make efficient use of the display device 11 and to display the image largely on the display device 11, which enables the image displayed to become easy to see, with improved convenience. For example, even a small-sized display device 11 of a portable information equipment can provide an easy-to-see image.

Moreover, at this time, since an image is displayed at the larger one of the vertical and horizontal image magnification ratios on the display device 11, in displaying the image on a rectangular display device 11, the image can appear most largely and becomes easy to see thereon, with improved convenience.

Still moreover, when image information is stored in the image information storing section 5*a* and the image stored therein is displayed on the display device 11, the image stored therein is displayed on the display device 11 at the magnification ratio stored in a state associated with that image; hence, there is no need to again calculate the magnification ratio in the image processing section 8*a*, thus leading to an increase in processing speed.

In addition, since the image information storing section 5*a* always stores the position (coordinate value) of the image displayed last time on the display device 11 in a state associated with the magnification ratio used at that display, it is possible to preferentially display that display position, which enables an image portion, a user seems to desire, to be displayed quickly on the display device 11. In addition, since the user can quickly display the image on the display device 11 at a magnification ratio the user seems to desires, for example, there is no need for the user to manipulate the operating section 2 for adjusting the display magnification, with improved convenience.

(B) Description of Second Embodiment

Figure 6:
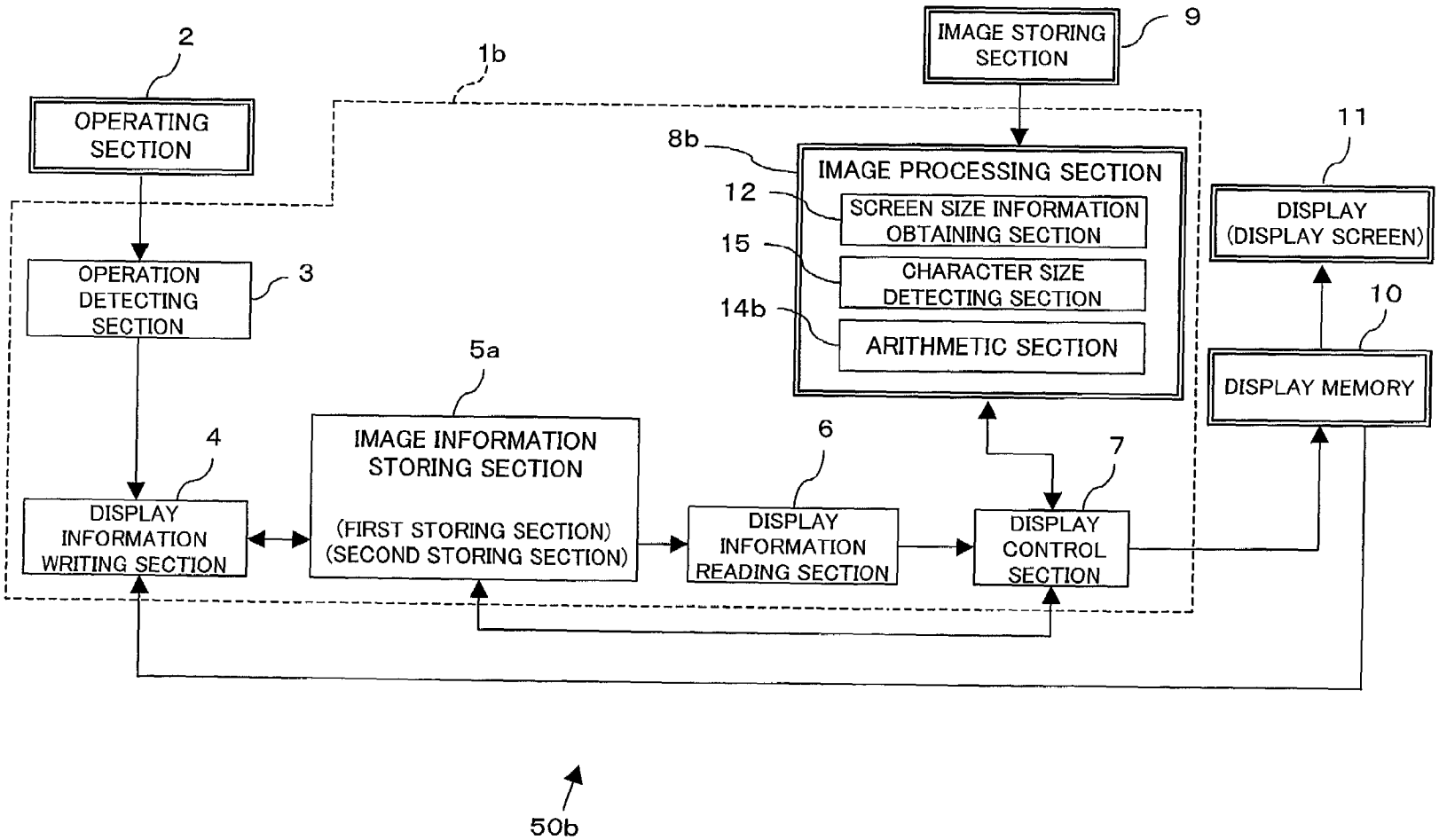
FIG. 6 is a block diagram showing a functional configuration of an image displaying apparatus equipped with an image display control unit according to a second embodiment of the invention.

FIG. 6 is a block diagram showing a functional configuration of an image displaying apparatus 50*b* equipped with an image display control unit 1*b* according to a second embodiment of the present invention. As FIG. 6 shows, the image displaying apparatus including the image display control unit 1*b* according to the second embodiment of the present invention is, for example, a portable personal computer, a viewer or the like and is provided with a small-sized display device (display screen) such as a liquid crystal display 11, as well as the image displaying apparatus 50*a* shown in FIG. 1.

The image display control unit 1*b* according to the second embodiment of the present invention has a hardware configuration almost similar to that of the image display control unit 1*a* according to the first embodiment shown in FIG. 2, and the detailed description thereof will be omitted for brevity. In addition, in the illustration, the same reference numerals as those used above represent the same or substantially same parts, and the description thereof will be omitted for simplicity.

Although the image display control unit 1*b* according to the second embodiment has almost same configuration as that of the image display control unit 1*a* according to the first embodiment, except that an image processing section 8*b* is provided in place of the image processing section 8*a*.

In addition, in the image display control unit 1*b*, an MPU 20 executes a program stored in a non-volatile memory 23 or a hard disk (not shown), thereby controlling the display of an image on a display device 11. At this time, the execution of a program (image display control program), stored in a hard disk, a ROM or the like, by the MPU 20 produces the functions of an operation detecting section 3, a display information writing section 4, a display information reading section 6, a display control section 7 and an image processing section 8*b*.

The image processing section 8*b* is for processing an image stored in an image storing section 9, and includes a screen size information obtaining section 12, a character size detecting section 15 and an arithmetic section 14*b*.

The character size detecting section 15 is for detecting a size of a character in an image, and is made to detect a character size used most frequently in an image.

The reason for detecting the character size used most frequently in the image is that it is considered that, in an image including characters, a writing using the character sizes of the most characters in number constitutes a main body, and this main body is required to be read certainly in the display device 11. Concretely, the character size detecting section 15 totalizes each of first and second histograms for each of images formed by dividing an original image into sixteen parts to obtain a character size (pixel unit) of the main body, as will be described hereinbelow. Following this, the arithmetic section 14*b* calculates a magnification ratio on the basis of the obtained character size.

Figures 7A, 7B, 7C:
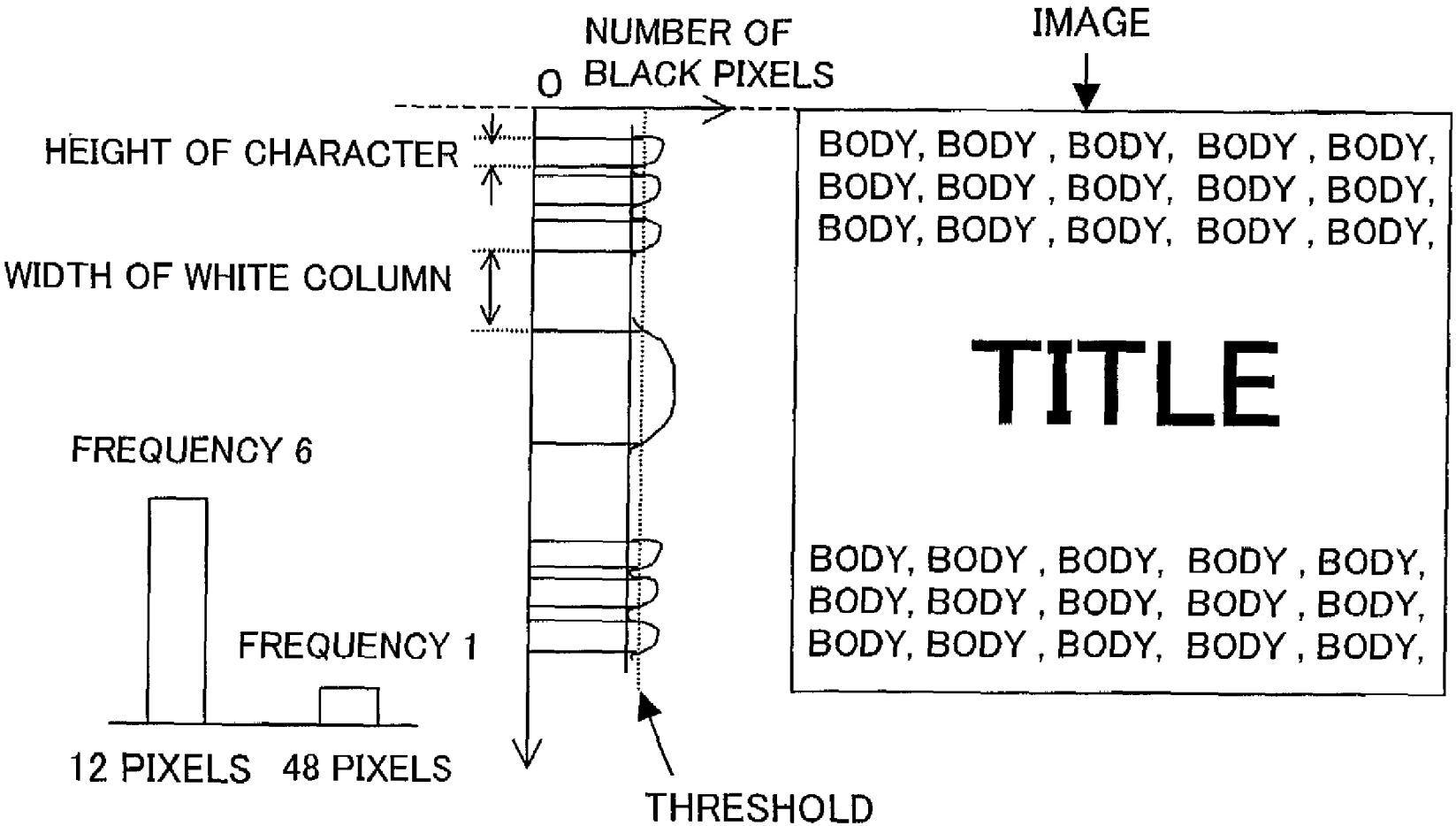
FIG. 7A is an illustration of a second histogram.
FIG. 7B is an illustration of a first histogram.
FIG. 7C is an illustration of an example of an image including characters.

FIGS. 7A to 7C are illustrations useful for explaining a character size detecting method. FIG. 7A is an illustration of a second histogram, FIG. 7B is an illustration of a first histogram, and FIG. 7C is an illustration of an example of an image including characters (words). In FIG. 7C, the image is made in a state where black characters are arranged on a white background, and is composed of two types of characters: one is a character (body, body, . . . , body) whose number of pixels in a character height direction is twelve and the other is a character (TITLE) whose number of pixels in a character height direction is forty eight.

The character size detecting section 15 divides an inputted image into a predetermined number of images (in this embodiment, four (in a vertical direction)×four (in a horizontal direction)=sixteen divisions), and with respect to divided images, sums up the numbers of black pixels in the horizontal direction in units of pixels in the vertical direction, thereby making out a histogram (first histogram) shown in FIG. 7B.

Incidentally, the reason for the division of an inputted image into a plurality of images is because of avoiding misunderstanding and/or stemming from a title portion, a picture portion and others in an image. Moreover, although the original image is divided into sixteen parts in the second embodiment, the present invention is not limited to this, but it is also possible to divide into sections whose number is other than sixteen. That is, the present invention covers all changes and modifications which do not constitute departures from the spirit and scope of the invention.

Thereafter, the character size detecting section 15 measures, with regard to the first histogram, a width (vertical dimension in FIG. 7B: number of pixels) of each of columns organizing a histogram, and accumulates the frequencies according to number of pixels with respect to the number of columns, thus making out the second histogram (see FIG. 7A).

In addition, the character size detecting section 15 obtains the number of pixels appearing most frequently in this second histogram. Still additionally, the character size detecting section 15 executes like the processing as above on each of the images formed by dividing the original image into sixteen parts, and sends the number of pixels appearing most frequently as a most frequently used character size to the arithmetic section 14*b*.

The arithmetic section 14*b* is for calculating an image magnification ratio on the basis of the character size detected in the character size detecting section 15 so that a character in an image is displayed at a predetermined size on the display device 11. Concretely, the arithmetic section 14*b* obtains the magnification ratio according to the following equation:

magnification ratio=appropriate character size/detected character size.

For example, assuming that the "detected character size" is taken as forty pixels and the "appropriate character size" is taken as five pixels, when the original image is displayed at a magnification ratio (reduction ratio) of 5/40, the character used most frequently in the original image is displayed with five pixels on the display device 11, which provides an easy-to-see condition to the user.

Figure 10:
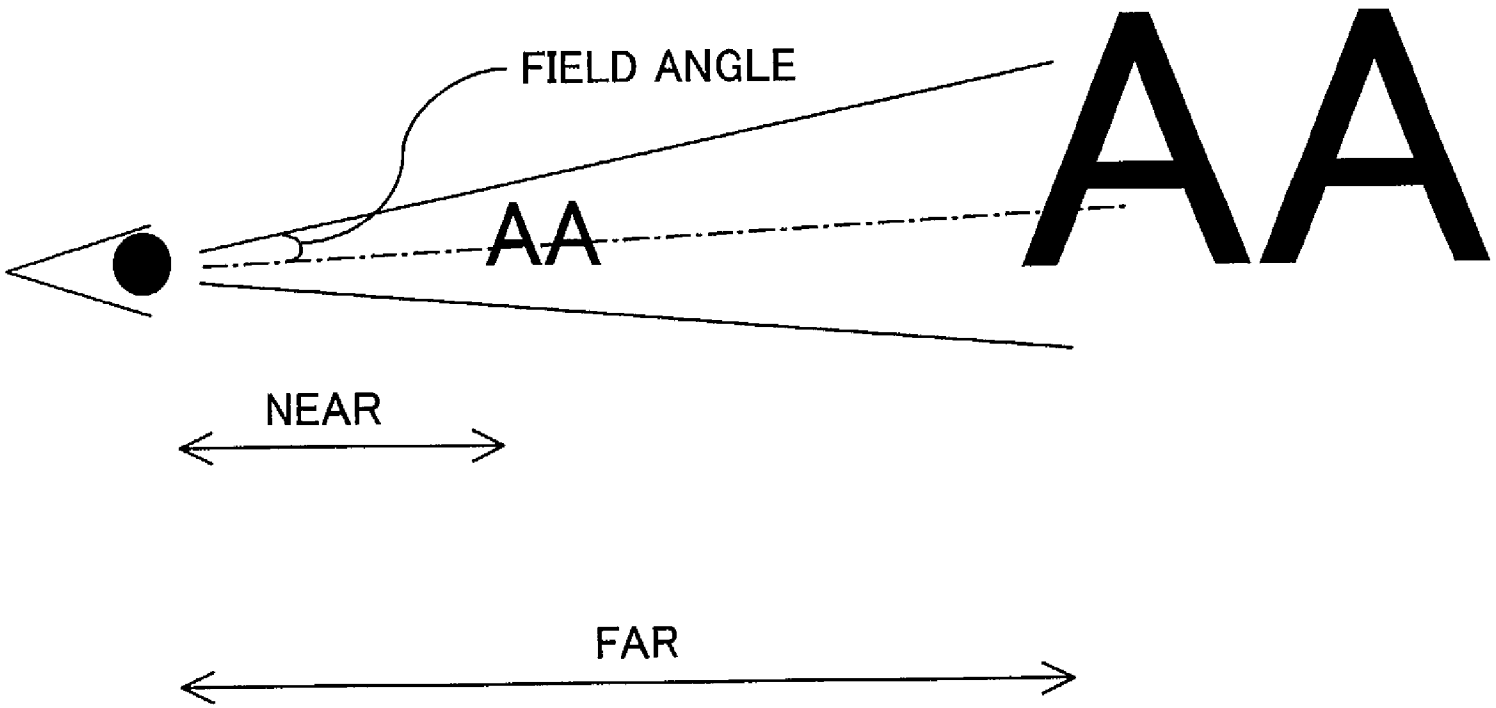
FIG. 10 is an illustration useful for explaining the relationship between a size of a character displayed on a display and a field angle.

Referring here to FIG. 10, a description will be given of an example of a method of calculating a character size (appropriate character size) appearing on the display device 11.

FIG. 10 is an illustration useful for explaining the relationship between a character size displayed on the display device 11 and a field angle. As FIG. 10 shows, for calculating the magnification ratio of an image, it is also appropriate that the arithmetic section 14*b* calculates a magnification ratio so that, when a user sees a character displayed on the display device 11, a field angle in a character height direction in a user's eyeball surface assumes a specified value. Particularly, it is preferable to calculate the magnification ratio so that, for example, the field angle becomes approximately 0.19 to 0.475 degrees.

Concretely, the arithmetic section 14*b* supposes a gap between the display device 11 and the user's eye in use in advance, and sets a character size (character height) on the basis of the separation so that the field angle in the character height direction in the user's eyeball surface becomes, for example, approximately 0.19 to 0.475 degrees.

That is, as FIG. 10 shows, for example, in the case of a portable viewer where the gap between the user's eye and the display device 11 in use is short (for example, approximately 20 cm), the magnification ratio is set so that the size (character height) of a character to be displayed on the display device 11 becomes small. On the other hand, in a case in which the gap between the user and the display device 11 is for in use, the magnification ratio is set so that the size (character height) of a character to be displayed on the display device 11 becomes large.

Furthermore, even in a case in which the image display control unit 1*b* according to the second embodiment is applied to a large-sized display device or the like which is to be watched at a relatively separated position, using a magnification ratio determined so that the field angle in the user's eyeball becomes approximately 0.19 to 0.475 degrees, the character size in the height direction is set to the distance between the user and the display device. Also in this case, an image can be displayed on the display device at a magnification ratio which produces display of a character with a size optimal to the user.

With this arrangement, no matter how long the gap between the user's eye and the display device 11 may be, it is possible to display of a character with a size, which presents an easy-to-see condition to the user, on the display device 11.

Figure 8:
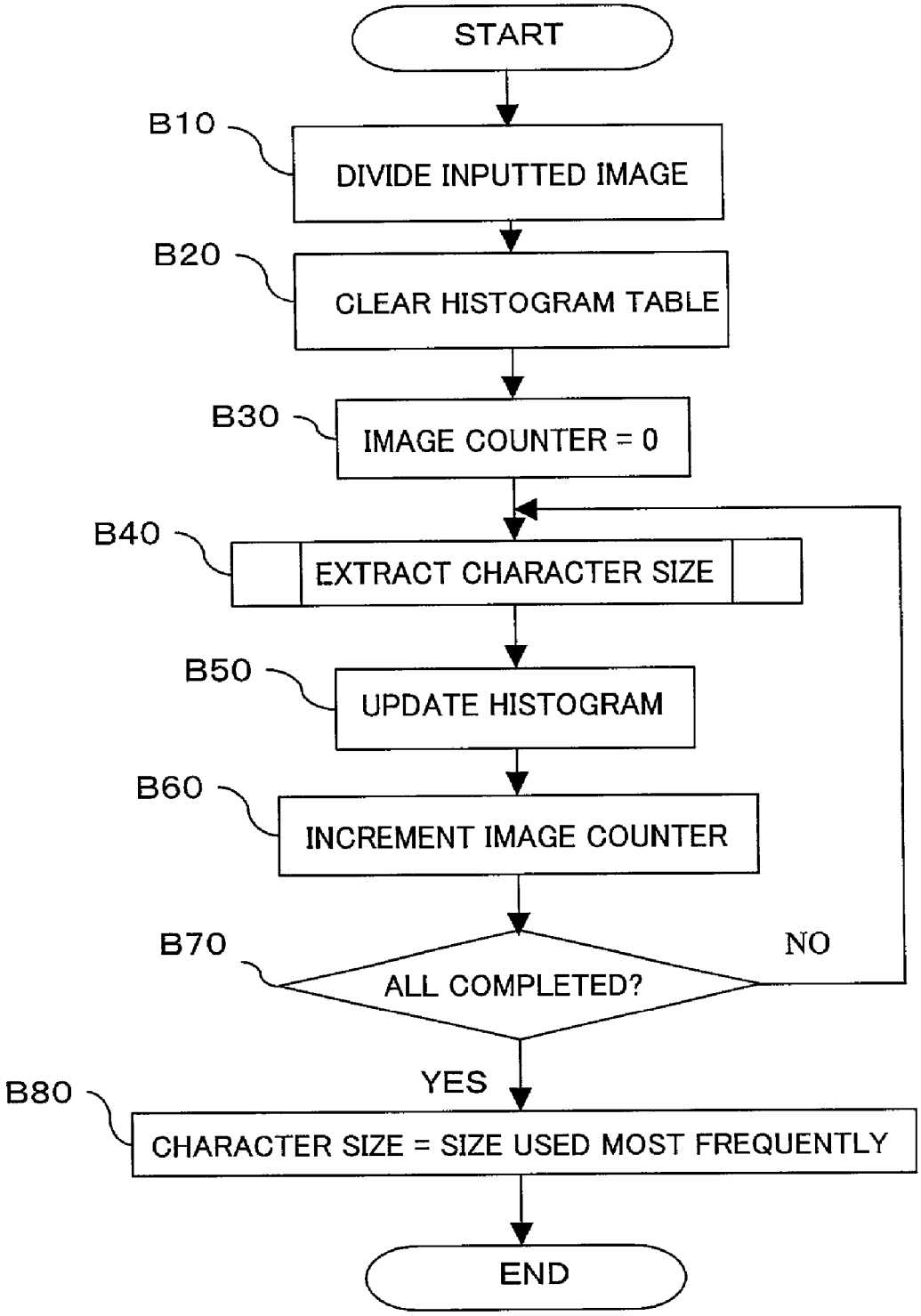
FIG. 8 is a flow chart useful for explaining an image display control method for use in an image display control unit according to each of the embodiments of the invention.

Referring to a flow chart (steps B10 to B80) of FIG. 8, a description will be given hereinbelow of an image display control method in the image display control unit 1*b* thus arranged according to the second embodiment of the present invention.

The character size detecting section 15 divides an original image obtained from the image storing section 9 into sixteen divided images (step B10) and clears a histogram table and an image counter (steps B20 and B30). In addition, the character size detecting section 15 extracts a character size in one divided image of the original image (step B40). A concrete character size detecting method in the step B40 will be described later.

Following this, the character size detecting section 15 makes out or updates a histogram in accordance with the extracted character size (step B50), and increments the image counter (step B60).

Subsequently, the character size detecting section 15 makes a decision as to whether or not the character size extraction is made on all the divided images of the original image, that is, on whether or not the value of the image counter reaches sixteen (step B70). If the character size extraction on all the divided images does not reach completion, that is, when the value of the image counter is below sixteen (see "NO" route from step B70), the operational flow returns to the step B40.

On the other hand, if the character size extraction on all of the sixteen divided images reaches completion (see "YES" route from step B70), the character size detecting section 15 makes a decision that the character size appearing most frequently in the histogram table is the character size used most frequently in the entire image, and hands over that character size (character height) to the arithmetic section 14*b* (step B80).

Figure 9:
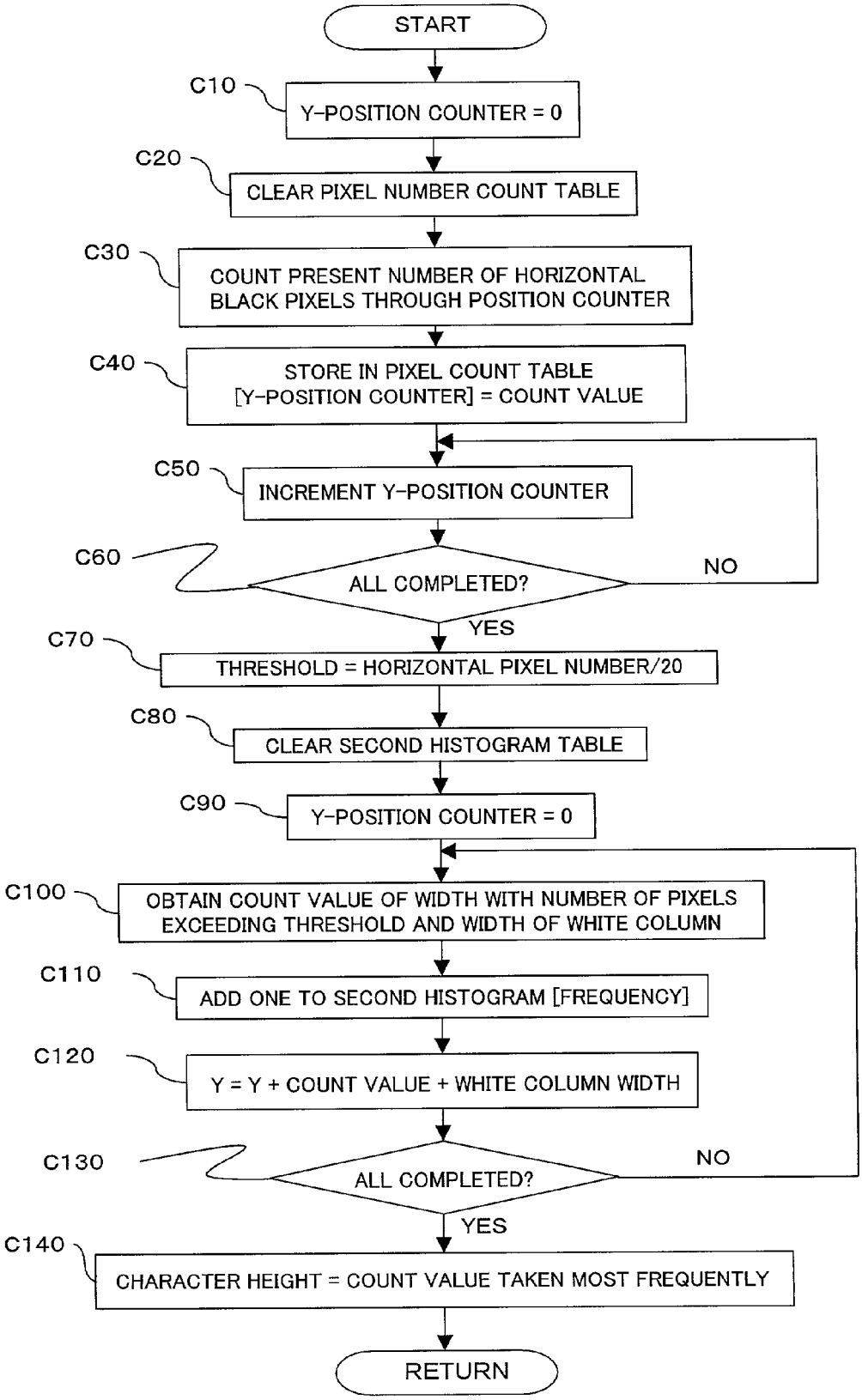
FIG. 9 is a flow chart useful for explaining a more concrete character size detecting method in a character size detecting section.

Secondly, referring to FIGS. 7A to 7C and a flow chart (steps C10 to C140) of FIG. 9, a description will be given hereinbelow of a concrete character size detecting method in the character size detecting section 15.

The character size detecting section 15 resets a Y-position counter to zero (step C10). The "Y-position" signifies a vertical position in an image, and is expressed in terms of pixels. In the case of the second embodiment, in the image shown in FIG. 7C, the value of this Y-position counter becomes higher toward the lower side in a state where an upper and left position is set as zero.

Then, the character size detecting section 15 clears a pixel number count table (first histogram table) (step C20), and calculates the sum of the numbers of black pixels in a horizontal direction at a vertical position of an image indicated by the Y-position counter (step C30), and stores the calculation result in a pixel count table [Y-position counter] (step C40).

Thereafter, the character size detecting section 15 increments the Y-position counter (step C50), and then makes a decision as to whether or not the Y-position arrives at the lower end of the image (step C60). If the Y-position does not arrive at the lower end of the image (see "NO" route from step C60), the operational flow returns to the step C30.

The steps C30 to C60 are repeatedly conducted, thus forming a first histogram.

On the other hand, if the Y-position arrives at the lower end (see "YES" route from step C60), the character size detecting section 15 sets, as a threshold, a value obtained by dividing the horizontal size by 20 (step C70).

Incidentally, the threshold is not limited to the above-mentioned value obtained by dividing the horizontal size of the image by 20, but the present invention covers all changes and modifications which do not constitute departures from the spirit and scope of the invention.

Following this, the character size detecting section 15 for making out a second histogram table, once clears the second histogram (step C80) and then clears the Y-position counter again (step C90).

Moreover, the character size detecting section 15 measures, as the number of pixels, a width (character height; in a vertical direction in FIG. 7B) of a column over the threshold set in the step C70 in the first histogram, and measures, as the number of pixels, an interval (width of a white column) between this column and the column adjacent thereto (step C100).

Still moreover, in the second histogram, the character size detecting section 15 adds one to a value (frequency) corresponding to the number of pixels (character height) of the width of the column obtained in the step C100 (step C110). Subsequently, the character size detecting section 15 adds "character height+white column width" to the value of the Y-position counter (step C120), and makes a decision as to whether or not the Y-position arrives at the lower end of the image (step C130). If the Y-position does not arrive at the lower end of the image (see "NO" route from step C130), the operational flow returns to the step C100.

In this connection, the addition of the "character height+white column width" to the value of the Y-position counter in the step C120 causes the Y-position to shift to the next column in the first histogram. The repeated implementation of the steps C100 to C130 forms the second histogram.

On the other hand, if the Y-position arrives at the lower end of the image (see "YES" route from step C100), the character size detecting section 15 sets the character height (the number of pixels) showing the highest frequency in the second histogram as a character size used most frequently in the image (step C140).

For example, in the image shown in FIG. 7C, as FIG. 7A shows, the frequency of a character corresponding to a character height of twelve pixels assumes six while the frequency of a character corresponding to a character height of forty eight pixels makes one; therefore, the character size detecting section 15 detects the character size (character height) as twelve pixels.

Thus, when the character size detecting section 15 detects the size of a character used most frequently in the image (original image), then the arithmetic section 14*b* calculates a magnification ratio for an image to be displayed on the display device 11 on the basis of the detected character size according to the above-mentioned equation, and sends the calculated magnification ratio to the display control section 7.

Following this, the display control section 7 applies the magnification ratio, which is calculated in the arithmetic section 14*b*, to the image, which is stored in the image storing section 9, and loads it in the display memory 10, and the display device 11 displays the image stored in the display memory 10; in consequence, the image enlarged/reduced so that the size of a character used most frequently in the image becomes optimal to the user appears on the display device 11.

In addition, the display control section 7 writes the display information (see FIGS. 3 and 4) on the generated display image in the image information storing section 5*a*. Meanwhile, if the image to be displayed on the display device 11 is already stored in the image information storing section 5*a*, the display control section 7 displays the image on the display device 11 through the use of the magnification ratio stored in the image information storing section 5*a*.

Thus, with the image display control unit 1*b* and image displaying apparatus 50*b* according to the second embodiment of the present invention, an image magnification ratio is calculated on the basis of the character size, detected in the character size detecting section 15, in the arithmetic section 14*b* so that a character in an image is displayed at a predetermined size on the display device 11, and the image appears at the calculated magnification ratio on the display screen; in consequence, the character with a predetermined size appears in the image on the display device 11, thus improving the visibility of the character on the display device 11, which results in the improvement of convenience.

In addition, since the character size detecting section 15 detects the size of a character used most frequently in an image and the arithmetic section 14*b* calculates an image magnification ratio on the basis of the detected character size so that a character used most frequently in an image is displayed at a predetermined size on the display device 11 and displays the image on the display device 11 at the calculated magnification ratio, the image can be displayed on the display device 11 so that the character size used most frequently in the image is in an easiest-to-see condition to the user, with improved convenience.

Still additionally, since, with respect to a character used most frequently in an image, the arithmetic section 14*b* calculates a magnification ratio so that a field angle in a character height direction becomes, for example, approximately 0.19 to 0.475 degrees in the user's eyeball surface when the user watches the character displayed on the display device 11, no matter how large the display device 11 may be or no matter how far the gap between the display device 11 and the user may be, it is possible to display the image on the display device 11 so that the size of the character used most frequently in the image produces an easiest-to-see condition to the user, with improved convenience.

Incidentally, although, in calculating an image magnification ratio in the second embodiment, the arithmetic section 14*b* is designed to make the calculation so that the field angle in the character height direction in the user's eye surface becomes, for example, approximately 0.19 to 0.475 degrees when the user watches the character appearing on the display device 11, the present invention is not limited to this.

For example, in the second embodiment, it is on the assumption that the display control is implemented on a display device of an information terminal a user holds by a hand for use. In such a case, it is also possible that, when the arithmetic section 14*b* calculates the image magnification ratio, the character dimension in the character height direction on the display device 11 is determined to be, for example, approximately 2 mm to 5 mm.

The reason that the character height-direction dimension is determined to be approximately 2 mm to 5 mm on the display device 11 is because, as a result of a subjective evaluation on a character size on the display device 11 of the portable information terminal, it was found that, when the height of the character displayed on the display device 11 is 2 mm to 5 mm, the readability is securable. This enables acquiring the balance between the display-possible number of characters on the display device 11 and the character readability.

Furthermore, for calculating the image magnification ratio, it is also acceptable that the number of pixels in the character height direction on the display device 11 is set at, for example, approximately five to thirteen pixels. This also offers easy-to-see character display to the user on the display device 11.

The reason that the number of pixels in the character height direction on the display device 11 is set at approximately five to thirteen pixels is because it was found from an experiment that, even if characters with the same size is displayed at, for example, a resolution of an LCD, the numbers of pixels used for the character display differ from each other, and if the character has a large size to some extent, the readability thereof depends upon the number of pixels contributing to the character display.

In consequence, in the case of an image including a character, when the display is made at a character size (character height) of five to thirteen pixels, it is possible to acquire the balance between the display-possible number of characters on the display device 11 and the readability of the characters.

In addition, in the above-described second embodiment, although the image magnification ratio is calculated on the basis of the character size used most frequently in the image so that the character size used most frequently in the image takes an easiest-to-see condition to the user, the present invention is not limited to this.

For example, it is also appropriate that the character size detecting section 15 detects the smallest character size in an image and the arithmetic section 14*b* calculates a magnification ratio so that the smallest character appears in the image at a predetermined size (for example, a size visible to a user on the display device 11), and displays the image at this magnification ratio. With this arrangement, there is no need for the user to manipulate the operating section 2 for displaying a small character in an enlarged condition, which improves the convenience.

Likewise, it is also appropriate that the character size detecting section 15 detects the largest character in an image and the arithmetic section 14*b* calculate a magnification ratio so that the largest character appears in the image at a predetermined size (for example, a size certainly accommodated in the display device 11) for displaying the image at this magnification ratio. With this arrangement, there is no need for the user to manipulate the operating section 2 for displaying a large character in a reduced condition, which improves the convenience.

Moreover, the character size detecting method in the character size detecting section 15 is not limited to the above-mentioned method, but the present invention covers all changes and modifications which do not constitute departures from the spirit and scope of the invention. For example, it is also possible to detect the character size through the use of various manners such as a neural network or a character recognition.

(C) Description of Third Embodiment

Figure 11:
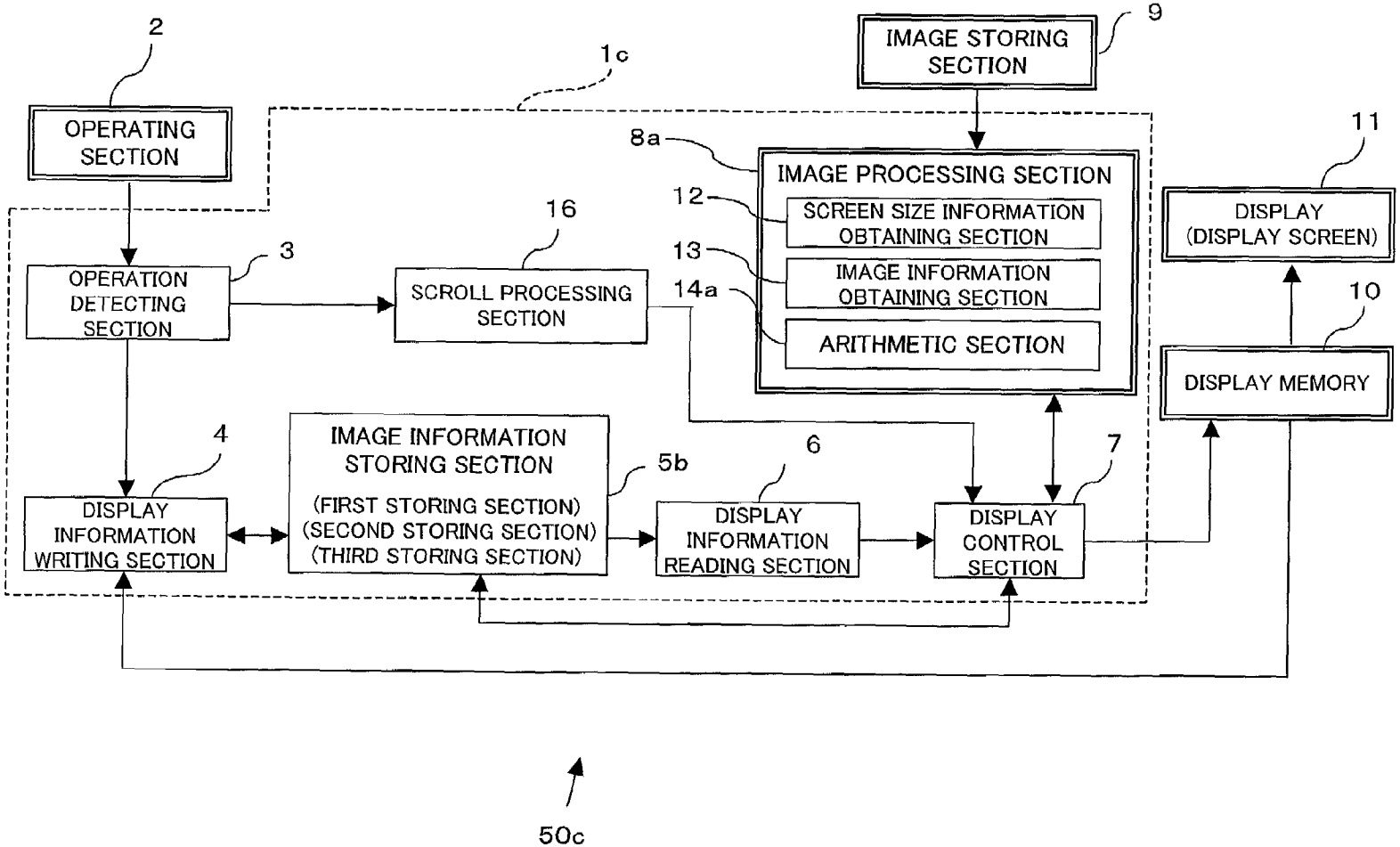
FIG. 11 is a block diagram showing a functional configuration of an image displaying apparatus equipped with an image display control unit according to a third embodiment of the invention.

FIG. 11 is a block diagram showing a functional configuration of an image displaying apparatus 50*c* equipped with an image display control unit 1*c* according to a third embodiment of the present invention. As FIG. 11 shows, as well as the image displaying apparatus 50*a* (see FIG. 1) and the image displaying apparatus 50*b* (see FIG. 6), the image displaying apparatus 50*c* including the image display control unit 1*c* according to the third embodiment of the present invention is constructed with, for example, a portable personal computer, a viewer or the like, and is equipped with a small-sized display device (display screen) such as a liquid crystal display 11.

The image display control unit 1*c* according to the third embodiment of the present invention has the almost same hardware configuration as that of the image display control unit 1*a* according to the first embodiment shown in FIG. 2, and the detailed description thereof will be omitted for brevity. In addition, the same reference numerals as those used above represent the same or corresponding parts, and the description thereof will be omitted for simplicity.

The image display control unit 1*c* according to the third embodiment is substantially similar to the image display control unit 1*a* according to the first embodiment, except that an image information storing section 5*b* provided in place of the image information storing section 5*a* and a scroll processing section 16 is provided additionally.

In addition, the image display control unit 1*c* is made to control image display on a display device 11 in a manner that an MPU 20 executes a program stored in a non-volatile memory 23 or a hard disk (not shown). At this time, the MPU 20 executes a program (image display control program) stored in a hard disk, a ROM or the like to function as an operation detecting section 3, a display information writing section 4, a display information reading section 6, a display control section 7, an image processing section 8*a* and a scroll processing section 16.

The scroll processing section 16 is for scrolling an image on the display device 11, and is made to scroll an image in vertical and horizontal directions on the display device 11 in accordance with an instruction from the operation detecting section 3. That is, when a user gives an instruction on scroll of an image through the use of an operating section 2, the operation detecting section 3 detects a scrolling operation, the scroll processing section 16 executes scroll processing, and the display control section 7 forms an image scrolled and displays it on the display device 11.

In this image displaying apparatus 50*c*, in order to select an image to be displayed on the display device 11 from a plurality of images, an index image produced by reducing original images can be displayed on the display device 11. In the following description, the display of an image on the display device 11 will sometimes be referred to hereinafter as "index display".

Figures 12A, 12B:
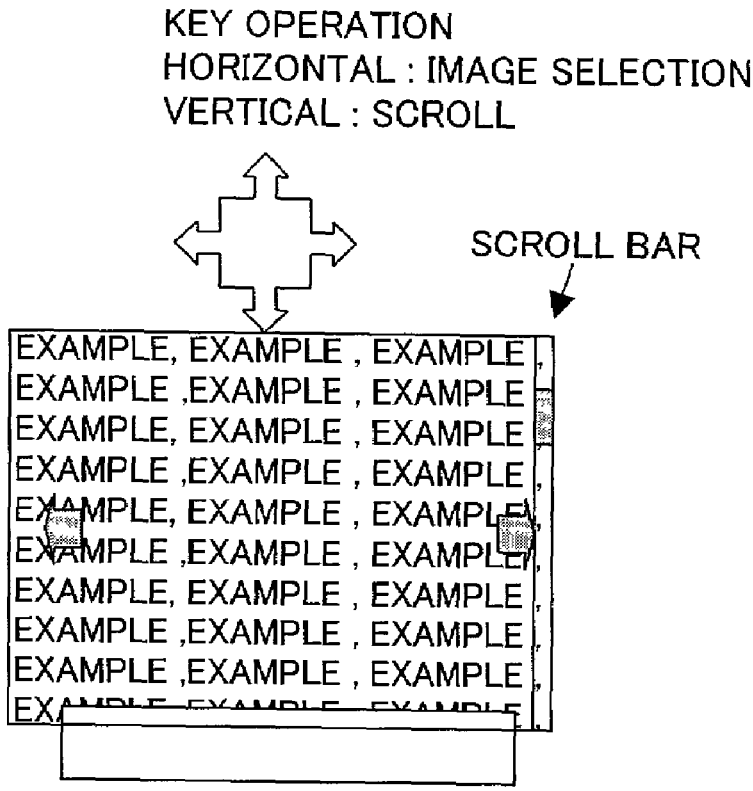
FIG. 12A is an illustration available for describing an index image switching key manipulating manner.
FIG. 12B is an illustration of an example of an index image displayed on a display.
Figure 14A:
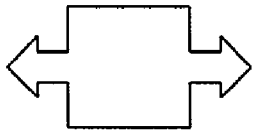
FIGS. 14A and 14B are illustrations for describing index display in a conventional image displaying apparatus.
Figure 14B:
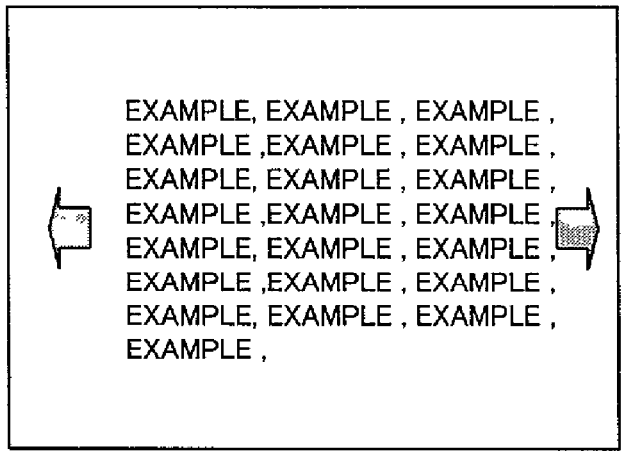

FIGS. 12A and 12B are illustrations useful for explaining display of an index image in the image display control unit 1*c* according to the third embodiment of the present invention. FIG. 12A is an illustration for describing an index image switching key manipulating method, and FIG. 12B is an illustration of an example of an index image displayed on the display device 11.

In the image display control unit 1*c* according to the third embodiment, as FIG. 12B shows, even in the index display, the image processing section 8*a* is designed to make display so that at least one of the vertical and horizontal sizes of the index image conforms or conforms generally to at least one of the vertical and horizontal display-possible sizes of the display device 11.

Accordingly, as FIG. 12B shows, the index image displayed throughout the display-possible range of the display device 11, and even in the case of the index display produced by reducing an original image, a user can recognize the contents of the image, for example, the user can read the characters in the image.

Incidentally, in the examples shown in FIGS. 12A and 12B, the horizontal side of the index image is made to conform or conform generally to the horizontal side of the display device 11. In addition, in FIG. 12A, the index image switching key is made such that its horizontal manipulation functions as an index image switching key while its vertical manipulation functions as a scroll key.

Furthermore, in the third embodiment, the index image switching key corresponds to the operating section 2, and the operational input by the index image switching key is communicated from the operating section 3 to the scroll processing section 16, with this scroll processing section 16 scrolling the image being displayed on the display device 11.

In a state of the index display, when the index image is scrolled through the use of the scroll key (the vertical manipulation of the index image switching key in FIG. 12A) as shown in FIG. 12A, the user can seize the contents of the image through the index image, which improves the convenience.

The image information storing section 5*b* has a feature similar to that of the image information storing section 5*a* in the image display control unit 1*a* according to the first embodiment or the image display control unit 1*b* according to the second embodiment, and further has a functions as a third storing section to store position information on an image to be displayed in a state associated with an original image in the display of an index image.

FIG. 13 illustratively shows a data structure of display information being stored in the image information storing section 5*b*, showing a data structure of display information on images corresponding to a plurality of pages.

As FIG. 13 shows, the image information storing section 5*b* is designed to store "magnification ratio", "first display position", "second display position" and "original image" in a state associated with each other according to "display page number" for image display on the display device 11, with the display information writing section 4 being made to write these display information therein.

The "display page number" represents a page number of an image to be displayed on the display device 11, and is for specifying the image to be displayed, for example, at the power-on. It is stored in the form of a natural number. The "magnification ratio" signifies the ratio of the size of the image to be displayed on the display device 11 to the size of the original image, with the value calculated in the arithmetic section 14*a* or the magnification ratio at the last display on the display device 11 being stored therein.

The "first display position" represents the position of an image (which will sometimes be referred to hereinafter as a "display image"), enlarged or reduced to the display size of the display device 11 for the display on the display device 11, in the form of a coordinate position in a case in which a predetermined reference position (for example, an upper and left position) in an original image is set as the origin.

The "second display position" represents the position of an image, to be displayed on the display device 11 in the index display, in the form of a coordinate position in a case in which a predetermined reference position (for example, an upper and left position) in an original image is set as the origin.

The "original image" is an image formed by regenerating or copying an image stored in the image storing section 9, and for example, is a bit map image or an image formed using various formats such as TIFF, JPEG and GIF.

In addition, if an original image is not stored in the image information storing section 5*b*, information, which represent that no original data is stored, is loaded in a area allocated for this "original image".

In the image display control unit 1c according to the third embodiment, the image information storing section 5*b* retains the "second display position" in a state associated with an original image, which enables a position different from the position in the display of an enlarged/reduced image on the display device 11 to be set on the display device 11 in thumbnail display.

For example, an image has a portion required to be enlarged for processing such as editing, the position information (coordinate value) on that portion is stored in the "first display position" of the image information storing section 5*b*, while in index display, position information (coordinate value) on a portion (for example, a title portion, or the like) convenient in discriminating that image is stored in the "second display position" of the image information storing section 5*b*, which permits switching the display place on the display device 11 between the enlargement/reduction display and the index display, thus leading to the improvement of convenience.

Particularly, in the index display, since the position information on an image to be displayed is retained in the image information storing section 5*b* in a state associated with an original image, that display position can preferentially be displayed in the display of the index image, which eliminates the need for the user to make a manipulation for the display of the display position, with improved convenience.

Incidentally, in the example shown in FIG. 12A, although the index image switching key also functions as the scroll key, the present invention is not limited to this, but it is also possible that the index image switching key and the scroll key are prepared separately.

Moreover, in the example shown in FIG. 12B, although the horizontal size of the index image is displayed to conform or conform generally to the horizontal size of the display device 11, the present invention is not limited to this, but it is also possible that the vertical side of the index image is displayed to conform or conform generally to the vertical side of the display device 11.

In the case of using one key as both the index image switching key and scroll key, it is preferable that the index image switching key is made such that its horizontal manipulation functions as the scroll key while its vertical manipulation functions as the index image switching key.

That is, in the case of serving as both the index image switching key and scroll key, if one which is not used for the selection of the index image is used as the scroll key, the convenience in the index display is improvable.

(D) Others

It should be understood that the present invention is not limited to the above-described embodiment, and that it is intended to cover all changes and modifications of the embodiments of the invention herein which do not constitute departures from the spirit and scope of the invention.

For example, it is also appropriate that an image processing section is provided which functions as both the image processing section 8*a* according to the first embodiment and the image processing section 8*b* according to the second embodiment, and a user operates the operating section 2 to selectively make the switching between these functions as needed in the image display.

For example, when the entire image is displayed on the display device 11, the function of the image processing section 8*a* is used to calculate a magnification ratio for an image in the image display, and when an image is displayed on the display device 11 for reading characters in the image, the function of the image processing section 8*b* is used to calculate a magnification ratio for the image in the image display. Accordingly, it is possible to display an image on the display device 11 in an optimal condition according to application.

In addition, although the image display control unit 1*c* according to the third embodiment is equipped with the image processing section 8*a* according to the first embodiment, the present invention is not limited to this, it is also appropriate that the image display control unit 1*c* is equipped with the image processing section 8*b* according to the second embodiment.

Thus, when an image including characters is displayed as an index image on the display device 11, the index image can be scrolled in a state where the image is displayed so that the character used most frequently in the image becomes in an easy-to-see condition to the user. Accordingly, also in the index display, it is possible to confirm the information stated in an image, which improves the convenience.

Also in this case, a character included in the index image can be displayed on the display device 11 in an easy-to-see condition.

Incidentally, the disclosure of each of the embodiments of the present invention enables manufacturing by those skilled in the art.

What is claimed is:

1. An image display control unit which displays an original image on a display screen, said control unit comprising:

a screen size information obtaining section obtaining information on a display size on the whole of said display screen;

an image information obtaining section obtaining information on vertical and horizontal sizes of said image;

an arithmetic section calculating an image magnification ratio so that at least one of said vertical and horizontal sizes of said image substantially conforms with at least one of vertical and horizontal display sizes on the whole of said display screen;

a first storing section which stores therein (i) the image magnification ratio calculated by said arithmetic section, (ii) display position information, which is the location of a part of the original image, which part is shown on the display screen, in the original image and (iii) the original image, in association with one another; and a display control section displaying said part of the original image on said display screen at the image magnification ratio which has been calculated by said arithmetic section after obtaining, if previously stored, the display position information and the image magnification ratio from said first storing section and, if not previously stored, displaying said part of the original image on said display screen without using the display position information and the image magnification ratio from said first storing section.

2. An image display control unit according to claim 1, wherein said arithmetic section calculates image magnification ratios for when said vertical size of said image is set to substantially conform with said vertical display size of said display screen and for when said horizontal size of said image is set to substantially conform with said horizontal display size of said display screen, and selects the larger one of the calculated vertical and horizontal magnification ratios and outputs the selected magnification ratio to said display control section.

3. An image display control unit which displays an original image on a display screen, said control unit comprising:

a character size detecting section obtaining a character size used most frequently in said image;

an arithmetic section calculating a magnification ratio of said image on the basis of the character size so that said character in said image is displayed at a predetermined size on said display screen;

a first storing section which stores therein (i) the image magnification ratio calculated by said arithmetic section, (ii) display position information, which is the location of a part of the original image, which part is shown on the display screen, in the original image and (iii) the original image, in association with one another; and a display control section displaying said part of the original image on said display screen at the image magnification ratio which has been calculated by said arithmetic section after obtaining, if previously stored, the display position information and the image magnification ratio from said first storing section and, if not previously stored, displaying said part of the original image on said display screen without using the display position information and the image magnification ratio from said first storing section.

4. An image display control unit according to claim 3, wherein said predetermined size is height of said character.

5. An image display control unit according to claim 3, wherein said predetermined size is the number of pixels for the character of height.

6. An image display control unit according to claim 3, wherein said predetermined size is a field angle in a character height direction.

7. An image display control unit according to claim 2, further comprising a second storing section associating display position information, on location of said image on the display screen, with said image and retaining the associated display position information.

8. An image display control unit according to claim 3, further comprising a second storing section associating display position information, on location of said image on the display screen, with said image and retaining the associated display position information.

9. An image display control unit according to claim 4, further comprising a second storing section associating display position information, on location of said image on the display screen, with said image and retaining the associated display position information.

10. An image display control unit according to claim 5, further comprising a second storing section associating display position information, on location of said image on the display screen, with said image and retaining the associated display position information.

11. An image display control unit according to claim 6, further comprising a second storing section associating display position information, on location of said image on the display screen, with said image and retaining the associated display position information.

12. An image display control unit according to claim 1, further comprising a second storing section associating display position information, on location of said image on the display screen, with said image and retaining the associated display position information.

13. An image display control unit according to claim 7, wherein said second storing section associates a display magnification of said image, which is displayed on said display screen, with said image and stores the associated magnification ratio.

14. An image display control unit according to claim 8, wherein said second storing section associates a display magnification of said image, which is displayed on said display screen, with said image and stores the associated magnification ratio.

15. An image display control unit according to claim 9, wherein said second storing section associates a display magnification of said image, which is displayed on said display screen, with said image and stores the associated magnification ratio.

16. An image display control unit according to claim 10, wherein said second storing section associates a display magnification of said image, which is displayed on said display screen, with said image and stores the associated magnification ratio.

17. An image display control unit according to claim 11, wherein said second storing section associates a display magnification of said image, which is displayed on said display screen, with said image and stores the associated magnification ratio.

18. An image display control unit according to claim 12, wherein said second storing section associates a display magnification of said image, which is displayed on said display screen, with said image and stores the associated magnification ratio.

19. An image display control unit according to claim 1, further comprising a scroll processing section scrolling said image on said display screen.

20. An image display control unit according to claim 3, further comprising a scroll processing section scrolling said image on said display screen.

21. An image display control unit according to claim 1, wherein an index image, which is produced by reducing an original image, is displayed as said image on said display screen as said image.

22. An image display control unit according to claim 3, wherein an index image, which is produced by reducing an original image, is displayed as said image on said display screen as said image.

23. An image display control unit according to claim 21, further comprising a third storing section associating position information, on location of an image to be displayed, with the original image and retaining the associated position information.

24. An image display control unit according to claim 22, further comprising a third storing section associating position information, on location of an image to be displayed, with the original image and retaining the associated position information.

25. An image display control method of displaying an image on a display screen for an image displaying apparatus, said control method comprising:

obtaining information on a display size on the whole of said display screen;

obtaining information on vertical and horizontal sizes of said image;

calculating an image magnification ratio so that at least one of said vertical and horizontal sizes of said image substantially conforms with at least one of vertical and horizontal display sizes on the whole of said display screen;

displaying said image at the image magnification ratio on said display screen;

associating the image magnification ratio and display position information on a location of said image on the display screen with said image;

retaining the image magnification ratio and the display position information on the location of said image on the display screen as associated with said image;

obtaining, after said retaining, the display position information; and subsequently displaying said image at the location indicated by the display position information and at the image magnification ratio on said display screen.

26. An image display control method according to claim 25, wherein, in said arithmetic step, said image magnification ratio is calculated for when said vertical size of said image is set to substantially conform with said vertical display size of said display screen and for when said horizontal size of said image is set to substantially conform with said horizontal display size of said display screen, and the larger magnification ratio is selected from the calculated vertical and horizontal magnification ratios.

27. An image display control method of displaying an image on a display screen, said control method comprising:

obtaining a character size used most frequently in said image;

calculating a magnification ratio of said image on the basis of the detected character size so that said character in said image is displayed at a predetermined size on said display screen;

displaying said image at the image magnification ratio on said display screen;

associating the magnification ratio and the display position information on a location of said image on the display screen with said image;

retaining the magnification ratio and the display position information on the location of said image on the display screen as associated with said image;

obtaining, after said retaining, the display position information; and subsequently displaying said image at the location indicated by the display position information and at the image magnification ratio on said display screen.

28. An image displaying apparatus comprising:

a display screen for displaying an image;

a screen size information obtaining section for obtaining information on a display size on the whole of said display screen;

an image information obtaining section for obtaining information on vertical and horizontal sizes of said image;

an arithmetic section for calculating an image magnification ratio so that at least one of said vertical and horizontal sizes of said image substantially conforms with at least one of vertical and horizontal display sizes on the whole of said display screen;

a storing section associating the image magnification ratio calculated by said arithmetic section and display position information on a location of said image on the display screen with said image and retaining display information in which the image magnification ratio, the display position information and said image are associated; and a display control section displaying said image on said display screen at the image magnification ratio which has been calculated by said arithmetic section after obtaining, if previously stored, the display position information and the image magnification from the storing section and, if not previously stored, displaying said part of the original image on said display screen without using the display position information and the image magnification ratio from said first storing section.

29. An image displaying apparatus according to claim 28, wherein said arithmetic section calculates said image magnification ratio for when said vertical size of said image is set to substantially conform with said vertical display size of said display screen and for when said horizontal size of said image is set to substantially conform with said horizontal display size of said display screen, and selects the larger one of the calculated vertical and horizontal magnification ratios and outputs the selected magnification ratio to said display control section.

30. An image displaying apparatus comprising:

a display screen displaying an image;

a character size detecting section obtaining a character size used most frequently in said image;

an arithmetic section calculating an image magnification ratio of said image on the basis of the detected character size so that said character is displayed at a predetermined size on said display screen;

a storing section associating the image magnification ratio calculated by said arithmetic section and display position information on a location of said image on the display screen with said image and retaining display information in which the image magnification ratio, the display position information and said image are associated; and a display control section displaying said image on said display screen at the image magnification ratio which has been calculated by said arithmetic section after obtaining, if-previously stored, the display position information and the image magnification ratio from the storing section and, if not previously stored, displaying said part of the original image on said display screen without using the display position information and the image magnification ratio from said first storing section.

31. An image display control program recorded computer-readable recording medium which retains an image display control program for making a computer implement an image display control function to display an image on a display screen of an image displaying apparatus, said image display control program making the computer function as:

a screen size information obtaining section obtaining information on a display size on the whole of said display screen;

an image information obtaining section obtaining information on vertical and horizontal sizes of said image;

an arithmetic section calculating an image magnification ratio so that at least one of said vertical and horizontal sizes of said image substantially conforms with at least one of vertical and horizontal display sizes on the whole of said display screen;

a storing section associating the image magnification ratio calculated by said arithmetic section and display position information on a location of said image on the display screen with said image and retaining display information in which the image magnification ratio, the display position information and said image are associated; and a display control section displaying said image on said display screen at the image magnification ratio which has been calculated by said arithmetic section after obtaining, if previously stored, the display position information and the image magnification ratio from the storing section and, if not previously stored, displaying said part of the original image on said display screen without using the display position information and the image magnification ratio from said first storing section.

32. An image display control program recorded computer-readable recording medium according to claim 31, wherein said arithmetic section calculates said image magnification ratio for when said vertical size of said image is set to substantially conform generally with said vertical display size of said display screen and for when said horizontal size of said image is set to substantially conform with said horizontal display size of said display screen, and to select the larger one of the calculated vertical and horizontal magnification ratios for outputting the selected magnification ratio to said display control section.

33. An image display control program recorded computer-readable recording medium which retains an image display control program for making a computer implement an image display control function to display an image on a display screen of an image displaying apparatus, said recording medium making said computer function as:

a character size detecting section obtaining a character size used most frequently in said image;

an arithmetic section calculating an image magnification ratio of said image on the basis of the detected character size so that said character is displayed at a predetermined size on said display screen;

a storing section associating the image magnification ratio calculated by said arithmetic section and display position information on a location of said image on the display screen with said image and retaining display information in which the image magnification ratio, the display position information and said image are associated; and a display control section displaying said image on said display screen at the image magnification ratio which has been calculated by said arithmetic section after obtaining, if-previously stored, the display position information and the image magnification ratio from the storing section and, if not previously stored, displaying said part of the original image on said display screen without using the display position information and the image magnification ratio from said first storing section.

34. An image display control method of displaying an image on a display screen for an image displaying apparatus, said control method comprising:

obtaining information on a display size on the whole of the display screen;

obtaining information on vertical and horizontal sizes of the image;

calculating an image magnification ratio so that at least one of the vertical and horizontal sizes of the image substantially conforms with at least one of vertical and horizontal display sizes on the whole of the display screen;

displaying the image at the magnification ratio on said display screen;

associating the magnification ratio and the display position information on a location of said image on the display screen with said image;

retaining the magnification ratio and the display position information on the location of said image on the display screen as associated with said image;

obtaining, after said retaining, the display position information; and subsequently displaying said image at the location indicated by the display position information and at the image magnification ratio on said display screen.

35. An image display control method of displaying an image on a display screen, comprising:

obtaining a character size used most frequently in the image;

calculating a magnification ratio of the image on the basis of the detected character size so that the character in the image is displayed at a predetermined size on the display screen;

displaying the image at the magnification ratio on said display screen;

associating the magnification ratio and the display position information on a location of said image on the display screen with said image;

retaining the magnification ratio and the display position information on the location of said image on the display screen as associated with said image;

obtaining, after said retaining, the display position information; and subsequently displaying said image at the location indicated by the display position information and at the image magnification ratio on said display screen.

36. An image display control unit according to claim 1, further comprising a display information writing section writing the image magnification ratio and the display position information in said first storing section in response to user input, after said display control section initially displays said part of the original image and prior to said display control section obtaining the display position information and the image magnification ratio from said first storing section.

* * * * *

UNITED STATES PATENT AND TRADEMARK OFFICE

CERTIFICATE OF CORRECTION

PATENT NO. : 7,307,643 B2
APPLICATION NO. : 09/826914
DATED : December 11, 2007
INVENTOR(S) : Jun Moroo et al.

It is certified that error appears in the above-identified patent and that said Letters Patent is hereby corrected as shown below:

Col. 26, line 44, delete "if-previously" and insert --if previously--, therefor.

Col. 27, line 51, delete "if-previously" and insert --if previously--, therefor.

Signed and Sealed this

Thirteenth Day of May, 2008

JON W. DUDAS
*Director of the United States Patent and Trademark Office*